US007845469B1

(12) United States Patent
Butler et al.

(10) Patent No.: US 7,845,469 B1
(45) Date of Patent: Dec. 7, 2010

(54) LADDER CADDY

(76) Inventors: David C. Butler, 1708 Old Farm Rd., Fairfield, IA (US) 52556; Clint L. Dixon, 7427 176TH Ave. West, Box 241, Reynolds, IL (US) 61279

( * ) Notice: Subject to any disclaimer, the term of this patent is extended or adjusted under 35 U.S.C. 154(b) by 603 days.

(21) Appl. No.: 11/780,279

(22) Filed: Jul. 19, 2007

Related U.S. Application Data

(60) Provisional application No. 60/807,898, filed on Jul. 20, 2006.

(51) Int. Cl.
*E04G 5/32* (2006.01)

(52) U.S. Cl. ..... 182/129; 248/210; 248/238

(58) Field of Classification Search ..... 182/129; 248/210, 238
See application file for complete search history.

(56) References Cited

U.S. PATENT DOCUMENTS

| | | | | | |
|---|---|---|---|---|---|
| 3,051,428 | A | * | 8/1962 | Schult | 248/210 |
| 3,642,240 | A | | 2/1972 | Hershey | |
| 4,120,472 | A | | 10/1978 | Balne | |
| 4,359,138 | A | * | 11/1982 | Kummerlin et al. | 182/214 |
| 4,480,810 | A | | 11/1984 | Hall | |
| 4,624,430 | A | | 11/1986 | Ehmke | |
| 4,653,608 | A | | 3/1987 | Casada | |
| 4,899,970 | A | | 2/1990 | Berzina | |
| 4,911,265 | A | * | 3/1990 | Skaggs | 182/121 |
| 5,052,581 | A | | 10/1991 | Christ et al. | |
| 5,106,045 | A | | 4/1992 | Bezotte | |
| 5,191,954 | A | | 3/1993 | Ledford | |
| 5,261,507 | A | * | 11/1993 | Williams et al. | 182/214 |
| 5,275,256 | A | | 1/1994 | Ellzey | |
| 5,370,263 | A | | 12/1994 | Brown | |
| D357,119 | S | | 4/1995 | Calmeise et al. | |
| 5,421,428 | A | | 6/1995 | Ingles | |
| 5,429,205 | A | | 7/1995 | Collins | |
| D361,664 | S | | 8/1995 | Brown | |
| 5,460,241 | A | | 10/1995 | LaBelle | |
| 5,542,553 | A | | 8/1996 | Penniman | |
| 5,622,278 | A | | 4/1997 | Fries et al. | |
| 5,649,682 | A | | 7/1997 | Martin | |
| 5,967,259 | A | | 10/1999 | Williams | |
| 6,098,748 | A | | 8/2000 | Harper et al. | |
| 6,105,911 | A | | 8/2000 | Olexson | |
| 6,848,540 | B2 | * | 2/2005 | Kvam | 182/129 |
| 7,077,238 | B2 | * | 7/2006 | Butler et al. | 182/129 |

* cited by examiner

*Primary Examiner*—Katherine W Mitchell
*Assistant Examiner*—Candace L Bradford
(74) *Attorney, Agent, or Firm*—James C. Nemmers; Shuttleworth & Ingersoll, PLC

(57) ABSTRACT

A versatile, easy to use, adjustable tool, paint, accessory and supply caddy for use on an extension ladder. The caddy can be used on ladders having rungs that are either round in cross section or have steps that are flat and more rectangular in shape. Upper and lower mounting cradles attach to any consecutive rungs of the extension ladder at two separate attachments points. A quick release, spring loaded clamping mechanism allows the ladder caddy to be quickly and securely attached and then removed from the ladder, with the upper and lower mounting cradles adjustable to accommodate different ladder rung/step shapes as well as diameters and distances between rungs. Paddle shaped trays can be locked in place on the caddy in a variety of positions, and the trays can swing over or under each other or be swung in opposing directions away from the ladder user thereby creating a useable work space adaptable to almost any ladder position.

11 Claims, 22 Drawing Sheets

LADDER CADDY

CROSS-REFERENCE TO RELATED APPLICATION

The present application claims priority under 35 USC 119 to Provisional Application No. 60/807,898, filed Jul. 20, 2006, the entire contents of which application is hereby incorporated by reference.

BACKGROUND OF THE INVENTION

1. Field of the Invention

This invention relates to the field of ladder accessories. More particularly, this invention relates to the field of an extension ladder or extended step ladder caddy for holding hand and power tools, painting supplies and similar supplies and equipment.

2. Description of Related Art

A workman at any job site often needs to have a significant number of tools and related equipment within easy reach. This is true whether the job site is at ground level, or is elevated off the ground such that the workman must perform the work while standing on a ladder. Being on a ladder creates a particular need to have many tools easily accessible, due to the difficulty of retrieving additional tools from a truck or other area at ground level, if necessary. Thus, it is important for a workman to have an effective ladder caddy for firmly holding a significant number of tools, equipment and supplies, and organizing and presenting these items in an ergonomic, efficient, and timely manner.

A number of tool caddies or tool holding devices have been proposed in the past. U.S. Pat. Nos. 6,105,911 5,649,682, and 4,624,430 disclose apparatuses for holding paint cans and/or paint brushes. U.S. Pat. No. 5,622,278 discloses a box similar to a tool chest that is mounted to a ladder, with loops on the outside of the box for holding a hammer, a power drill, and the like. U.S. Pat. Nos. 5,542,553 discloses a ladder caddy that is similar to a tool belt, and which is mounted to a step ladder. U.S. Pat. No. 4,480,810 discloses a ladder caddy having a box like structure and slotted plates for holding tools, which can be tightened to a ladder rung via a wing nut. U.S. Pat. No. 5,052,581 discloses a ladder supporting holding tray that includes an adjustable strut that is secured from below. U.S. Pat. No. 6,098,748 discloses an adjustable height tool bin systems for step ladders only. U.S. Pat. No. 5,460,241 discloses a platform accessory that mounts on two adjacent rungs of the ladder. U.S. Pat. No. 5,429,205 discloses a platform accessory provided for standing or placing accessories that protrudes to the rear of the ladder. U.S. Pat. No. 5,421,428 discloses a ladder guard which prevents unauthorized access to a ladder. U.S. Pat. No. 5,191,954 discloses a ladder platform and utility frame means formed by a foot plate supported by adjacent ladder rungs. U.S. Pat. No. 4,899,970 discloses a paint can hanger having a pair of outwardly extending paint can support arms. U.S. Pat. No. 4,359,138 discloses a supporting device for ladders which has two supports which can be connected with rungs of the ladder by two connecting devices. U.S. Pat. No. 6,848,540 B2 discloses an apparatus for attachment to the rungs of a ladder to securely hold a bucket and other accessories. U.S. Pat. No. 3,642,240 discloses a handy man's tool box and ladder accessory designed for use in conjunction with a rung type ladder. None of these devices, however, represents a completely satisfactory or highly versatile, adjustable solution to tool or material storage while working on an extension ladder. The ladder caddy disclosed in our prior U.S. Pat. No. 7,077,238 solves many of the problems of other prior art devices, but there are improvements to that ladder caddy that are disclosed herein.

INVENTION SUMMARY

The present invention provides an extremely versatile, easy to use, adjustable tool, paint, accessory and supply caddy for use on an extension ladder. The caddy of the invention can be used on ladders having rungs that are either round in cross section or have steps that are flat and more rectangular in shape providing a wider step surface. Both rungs and steps are usually referred to hereinafter simply as "rungs". So as to accommodate either type of ladder rung or step, generally concave upper and lower mounting cradles attach to any consecutive rungs of an extension ladder at two separate attachments points. A quick release, spring loaded clamping mechanism allows the ladder caddy to be quickly and securely attached and then removed from a ladder by using the clamping mechanism to attach either down facing upper or lower mounting cradles to the rungs of the ladder. In the installed position, the distance between the upper and lower mounting cradles is made to be adjustable, due to differing extension ladder rung/step shapes as well as diameters and distances between rungs. The down facing concave surfaces of the upper and lower mounting cradles are held against the tops of consecutive ladder rungs and are in turn locked onto each rung using the quick release spring loaded clamping mechanism. The quick release spring loaded clamping mechanism is activated by pushing down, turning and releasing the clamping mechanism handle. In one position, the device is "locked" onto the ladder rung. By turning the clamping mechanism 180 degrees, the device is then in the unlocked position and can then be easily removed from the ladder. The upper facing concave surfaces of the cradles provide an area for the mounting of a removable winged tool bar or provide a resting area for other elongated tools, such as levels, framing squares, piping, molding, trim, conduit, etc. A removable winged bar, when attached, acts as a combination D-handled power/air tool holder, coiled cord holder, and retaining device for holding pipe, conduit, and other similar materials. The removable winged tool bar is attached into either of the up facing mounting cradles by using a secure clamping mechanism (without spring). The secure clamping mechanism is activated by tightening or untightening the secure clamping mechanism handle. The means for connecting the two concave mounting cradles together is provided by two vertical parallel pivoting bolts spaced several inches apart. The heads of the vertical parallel threaded bolts are recessed into the top facing surface of the upper mounting cradle. The vertical parallel pivoting bolts thread into a female threaded hole located on the raised bosses on the lower mounting cradle. Once adjustment has been made to a specific ladder, the bolts can be locked into place on the lower mounting cradle by tightening the two jamb nuts. The two vertical parallel pivoting bolts also act as a pivotal center that support two adjustable paddle shaped trays which provide a number of useful purposes and pivot from side to side or front to back. The vertical parallel pivoting bolts are attached in alternate positions between the inverted mounting cradles to provide the user a level working area on the paddle shaped trays when the ladder is in the standard recommended lean of 15 degrees, such that when mounted on a ladder leaning at 15 degrees from vertical, the outwardly extending paddle shaped tray extends generally level and horizontal. The paddle shaped trays can be locked in place in a variety of positions by the means of adjustable locking knobs. By installing the trays in inverted, opposing positions on the vertical parallel pivoting bolts, the trays can swing over or under each other or be swung in opposing directions away from the ladder user thereby creating a useable work space adaptable to almost any ladder position. The paddle shaped trays can also be positioned away from the user by positioning the paddle shaped trays through the opening between two adjacent ladder rungs. The paddle shaped trays can include a number of holes, slots, apertures, recessed and raised surfaces for holding various hand tools and power drills, hardware, as well as cups and several different size industry standard paint containers. Furthermore the paddle shaped trays includes female threaded holes that will accept a threaded pipe section for a detachable device for securing a paint can retainer which holds a standard one gallon paint container onto the tray. The female threaded hole also acts as a receptacle for the tubular wrench, (also used for adjusting the vertical parallel pivoting bolts), and when installed in this position, the tubular wrench becomes a roll holder for paper towels, rolled masking paper or tape, etc. The entire ladder caddy assembly is easily removed and reattached to the ladder. The ladder can be extended in either direction while the assembly, (in most positions), is still attached. The overall width of the mounting cradles are preferably such that the cradles will attach to any industry standard ladder with clearance to either side between the cradle and the main upright rails of the ladder as well as the locking mechanism of the ladder which locks the two separate ladder sections together. Furthermore, correct positioning of the two vertical parallel pivoting bolts on the mounting cradles provides maximum adjustment for the paddle shaped trays to swing away or towards the ladder occupant. Exemplary embodiments of the invention are further described below with reference to the drawings, in which like numbers refer to like parts.

DETAILED DESCRIPTION OF THE PREFERRED EMBODIMENTS

Figure 1:
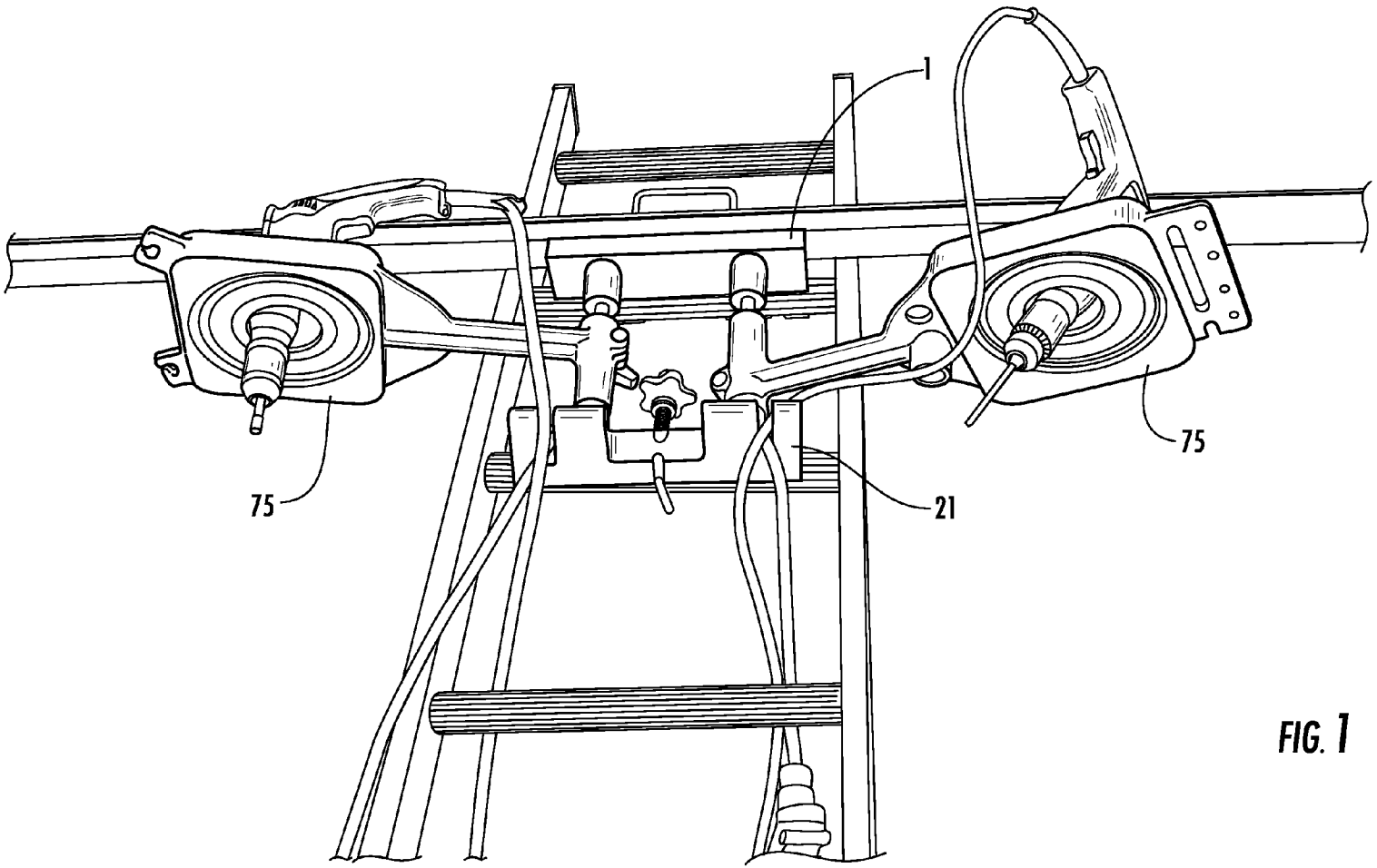
FIG. 1 is a perspective view showing the ladder caddy of the invention mounted on an extension ladder.
Figure 6:
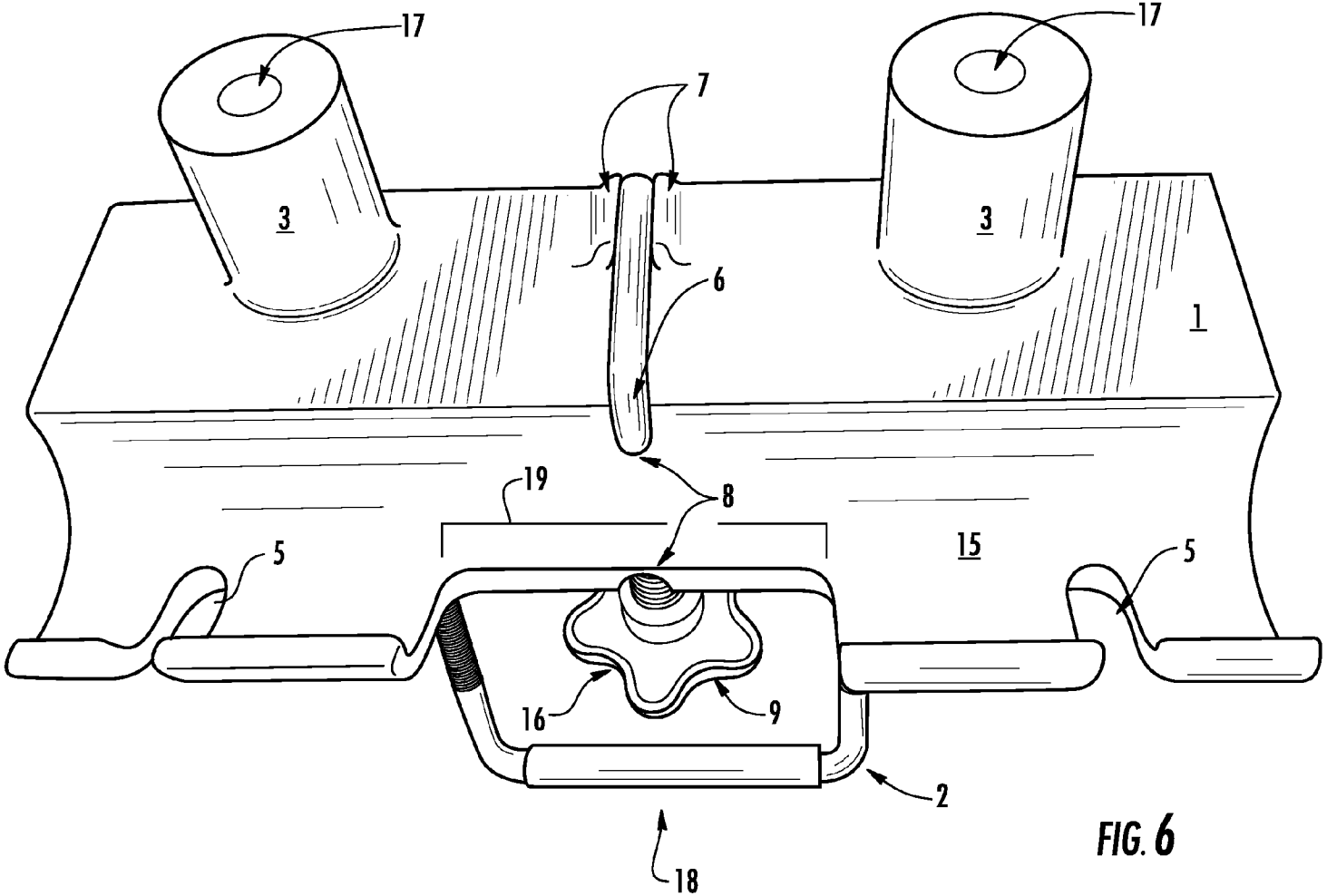
FIG. 6 shows a perspective view of the upper assembly of the ladder caddy of FIG. 5 inverted and viewed from below and from the rear.
Figure 7:
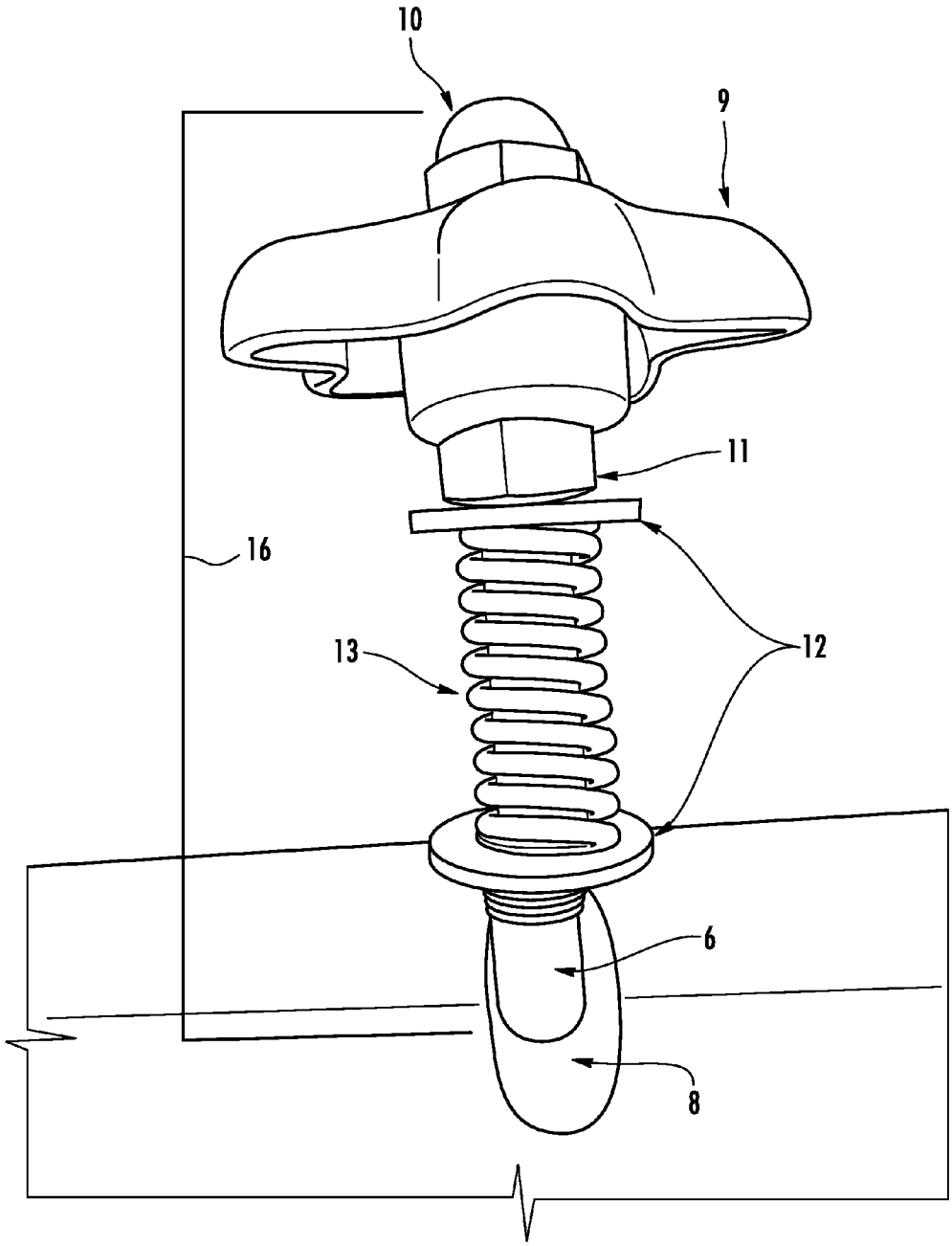
FIG. 7 is an enlarged perspective view of the spring loaded clamping assembly that locks the ladder caddy in place on the rung of a ladder.
Figure 9:
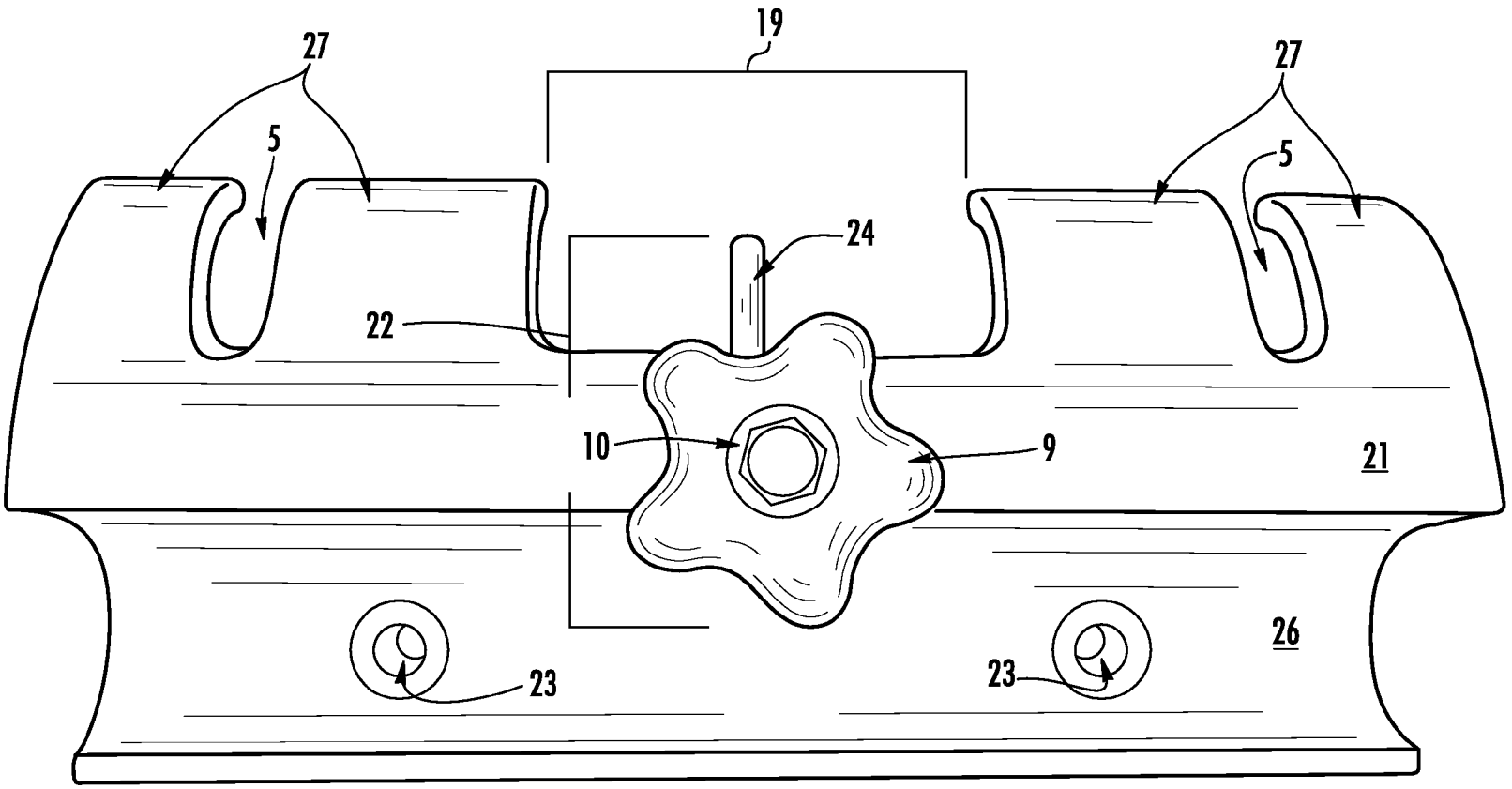
FIG. 9 shows the lower assembly of the ladder caddy of FIG. 8 viewed from below.

FIGS. 1-4 are views of one illustrative embodiment of the entire ladder caddy assembly of the invention with tool trays and a winged tool bar assembly included, and FIG. 1 shows the ladder caddy mounted on an extension ladder which, as is well known, has spaced apart rungs. The ladder caddy includes an upper mounting cradle assembly 1 and lower mounting cradle assembly 21. Upper mounting cradle 1 and lower mounting cradle 21 are spaced apart to accommodate the standard spacing between the rungs of a ladder, which spacing typically is approximately 12 inches. Thus, the spacing between the two mounting cradles 1 and 21 is adjustable, preferably between 11 and 13 inches, and more preferably 12 inches to adapt to different distances between ladder rungs as well as differences in ladder rung diameters or shapes. A concave mounting surface 26 (FIG. 9) on the lower side of the lower mounting cradle 21 rests on the upper half of the first ladder rung directly below the ladder rung where the upper mounting cradle 1 is positioned. A concave mounting surface 15 on the lower side of the upper mounting cradle 1, (see FIG. 6) is easily mounted on any industry standard extension ladder. A quick release spring loaded clamping assembly 16 (shown in detail in FIG. 7) provides a clamp to positively hold the entire assembly to a ladder. The upper mounting cradle 1 is held in place by turning the handle 9 of the clamping assembly 16, thereby locking the ladder caddy assembly onto a ladder rung. Upper acorn nut 10 and locking nut 11 keep the handle 9 from turning on clamp bar 6. Spring 13, with twin washers 12 located at each end of spring 13, keep tension on the spring 13 allowing the handle 9 to be pushed in a downward motion and then turned 180 degrees, thereby allowing the ladder caddy assembly to be locked or unlocked on the extension ladder rung. In the unlocked position, clamp bar 6 (FIG. 6) rests in the docking slot 7 located on the down side of the upper mounting cradle 1. The clamping assembly 16 is attached to the upper mounting cradle 1 through means of a slotted hole 8 which allows the clamp bar 6 to rest in place in the unlocked position of the docking slot 7 or the 180 degree reversed position of being locked on the ladder rung. The spring loaded clamping assembly 16, used for attaching the device to the ladder, and a secure clamping mechanism 22 (FIG. 9) used for attaching winged tool bar assembly 109 (described hereinafter), are interchangeable between upper and lower mounting cradles 1 and 21 as long as mechanisms are installed in inverted positions on opposing cradles. This is described in more detail hereinafter.

Figure 5:
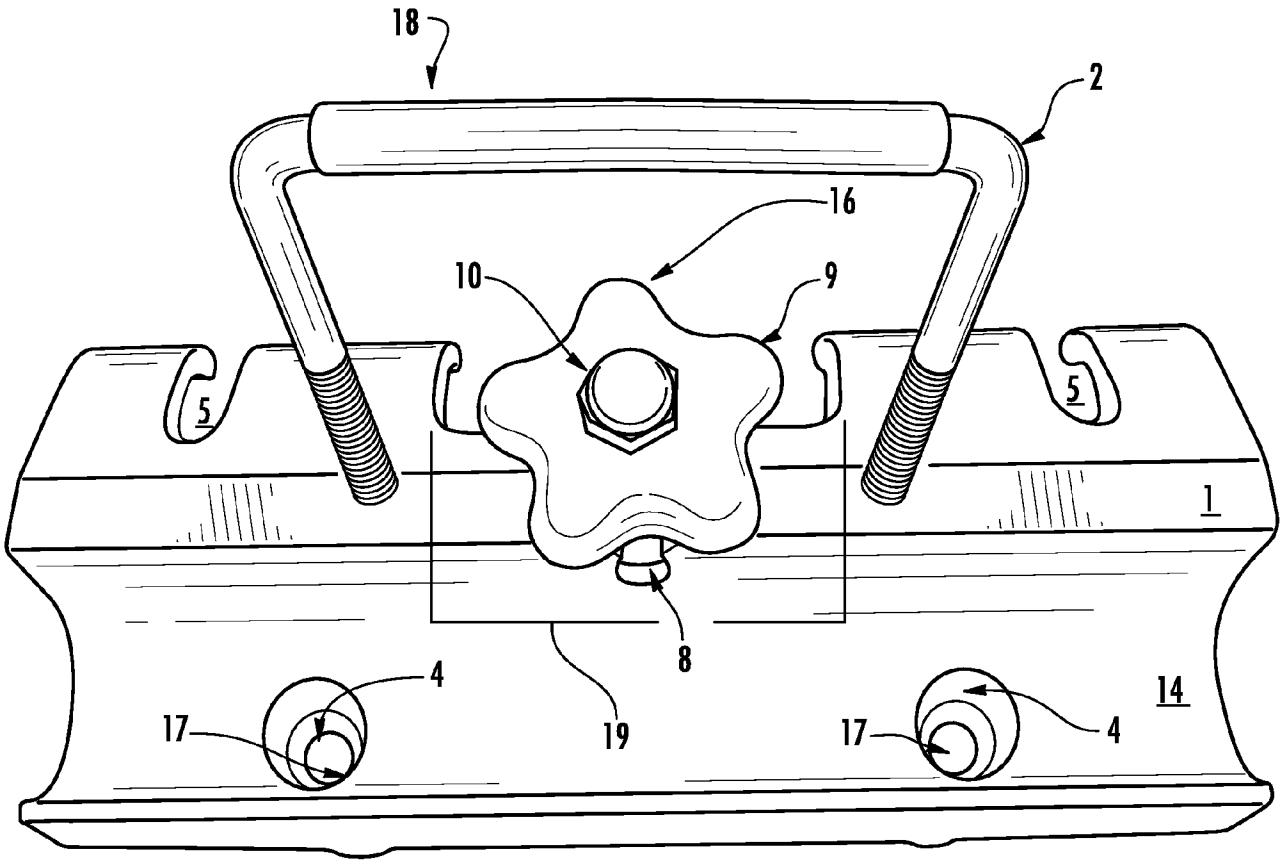
FIG. 5 shows a perspective view of the upper assembly of the ladder caddy of FIG. 1 when viewed from above and from the front.
Figure 11:
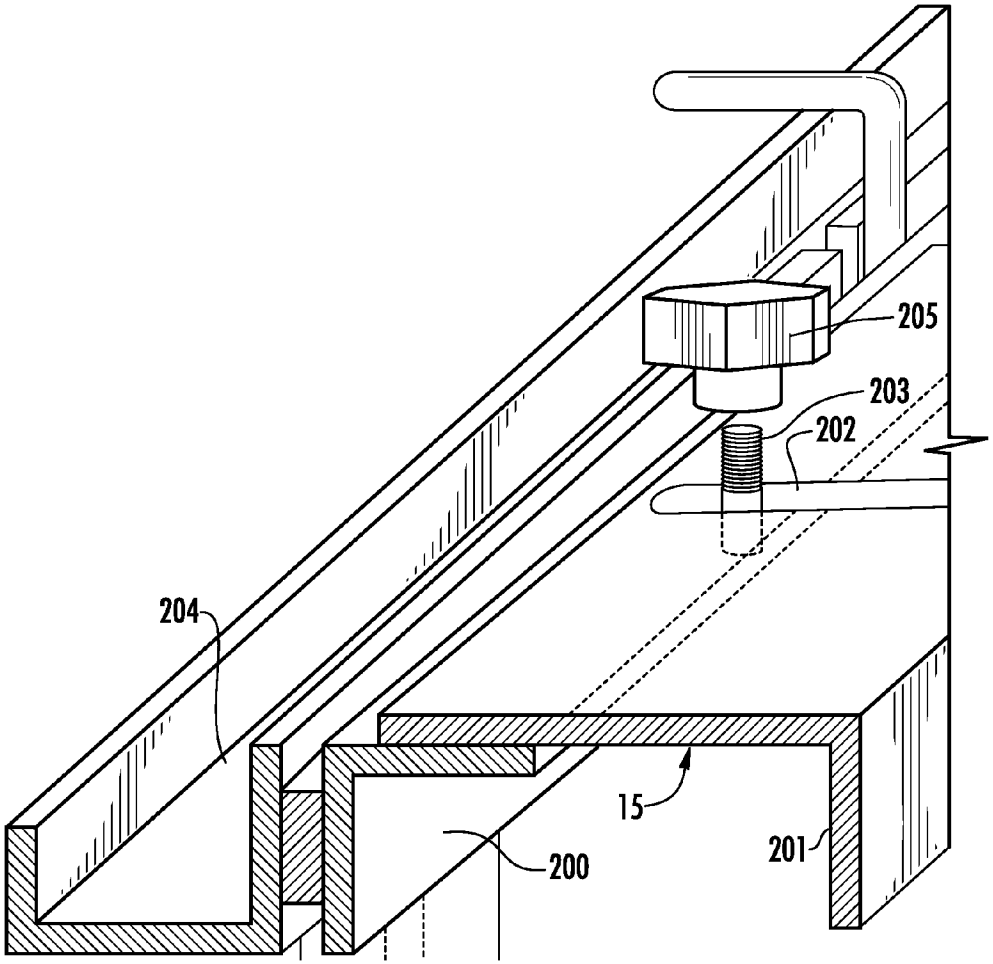
FIG. 11 is a perspective view of another embodiment of the cradle that is adjustable.

FIG. 11 illustrates a variation in the design of the upper and lower mounting cradles 1 and 21 that allows for adjustment of the width of the concave mounting surface 26 of the lower mounting cradles and the concave surface 15 of the upper mounting cradle 1. In this embodiment, the mounting surfaces 15 and 26 are not fixed dimensions, but the width of the mounting surfaces 15 and 26 can be varied to accommodate ladder steps or rungs or different sizes or shapes. For example, there are well know extension step ladders that instead of round rungs, there are provided steps of a generally flat, wide surface for the user's feet. To provide for attachment of the ladder caddy assembly of the invention to such steps, the mounting surfaces 15 and 26 are adjustable in width. FIG. 11 shows this feature incorporated into the upper mounting cradle 1, but it should be understood that similar structure would also be used in the lower mounting cradle 21. As illustrated in FIG. 11, the mounting surface 15 is formed by two overlapping L-shaped members 200 and 201, each of which has a slot 202. An attached welded stud 203 on the lower L-shaped member 200 extends through the slot 202 to mate and lock the members 200 and 201 in a selected position of the desired width to accommodate a ladder step. The two members 200 and 201 are secured to each other and made adjustable by means of the tightening knob 205. A concave mounting surface 204, similar to mounting surface 14 of the first embodiment shown in FIG. 5, is shown in FIG. 11 as also being rectangular in cross section, but it will be understand that this surface 204 could be curved as well. It should be further understood that the use of the word "concave" mounting surface in this specification includes a surface of any suitable cross sectional shape.

Figure 10:
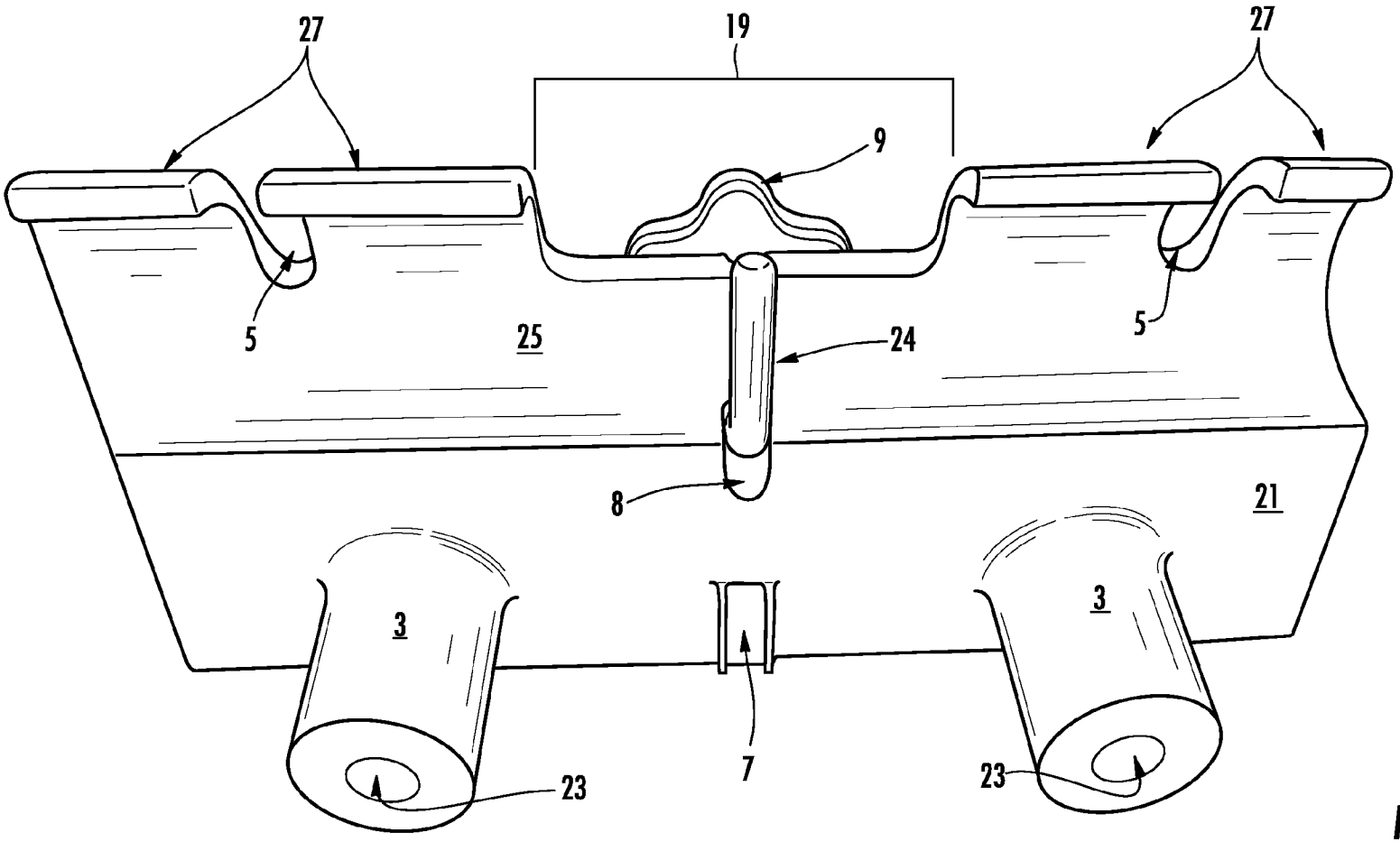
FIG. 10 is a perspective view of the lower assembly of the ladder caddy of FIG. 8 inverted and viewed from above and from the front.
Figure 10A:
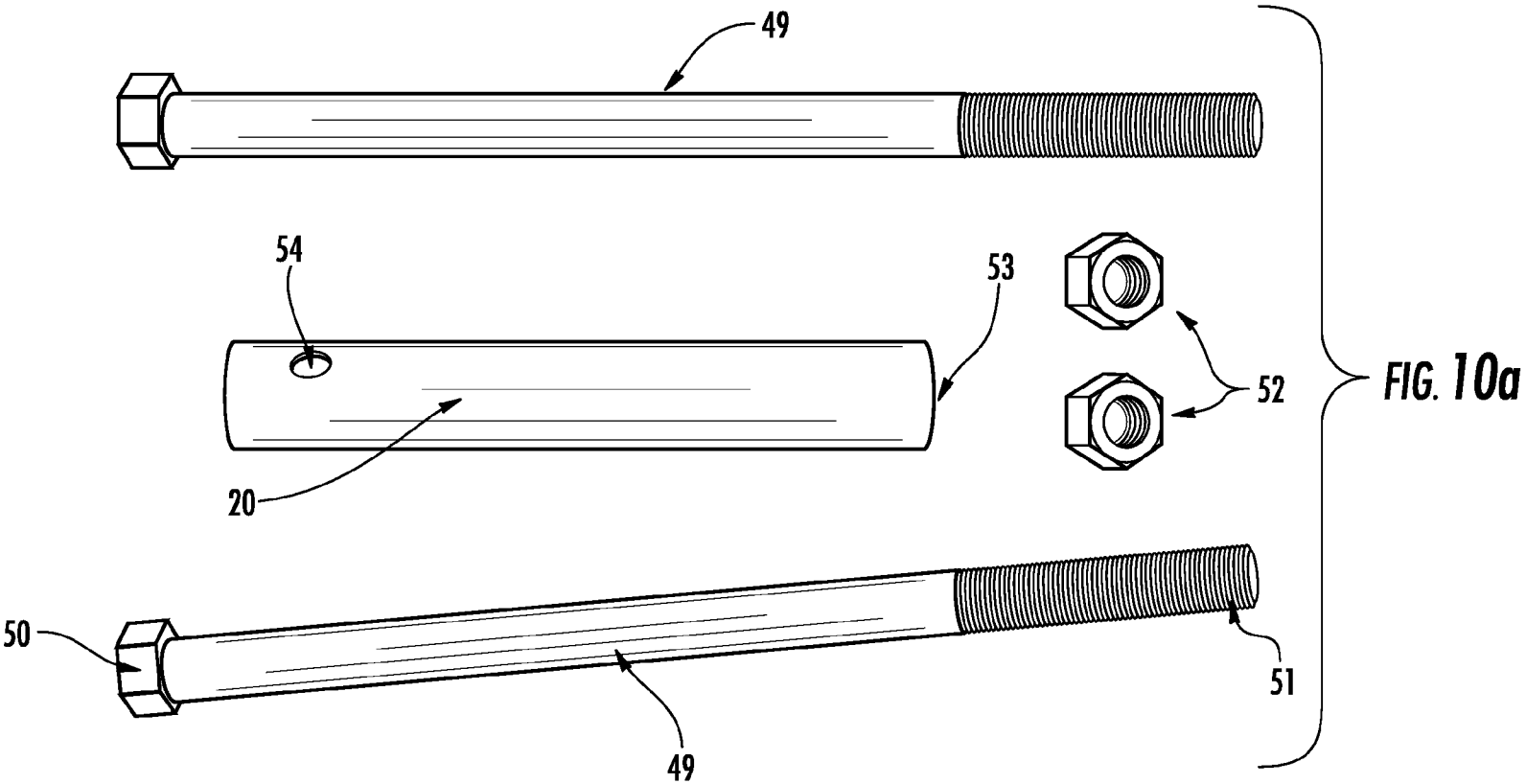
FIG. 10*a* is an exploded view of the bolt assemblies that joins the upper and lower cradle mounting assemblies.
Figure 12:
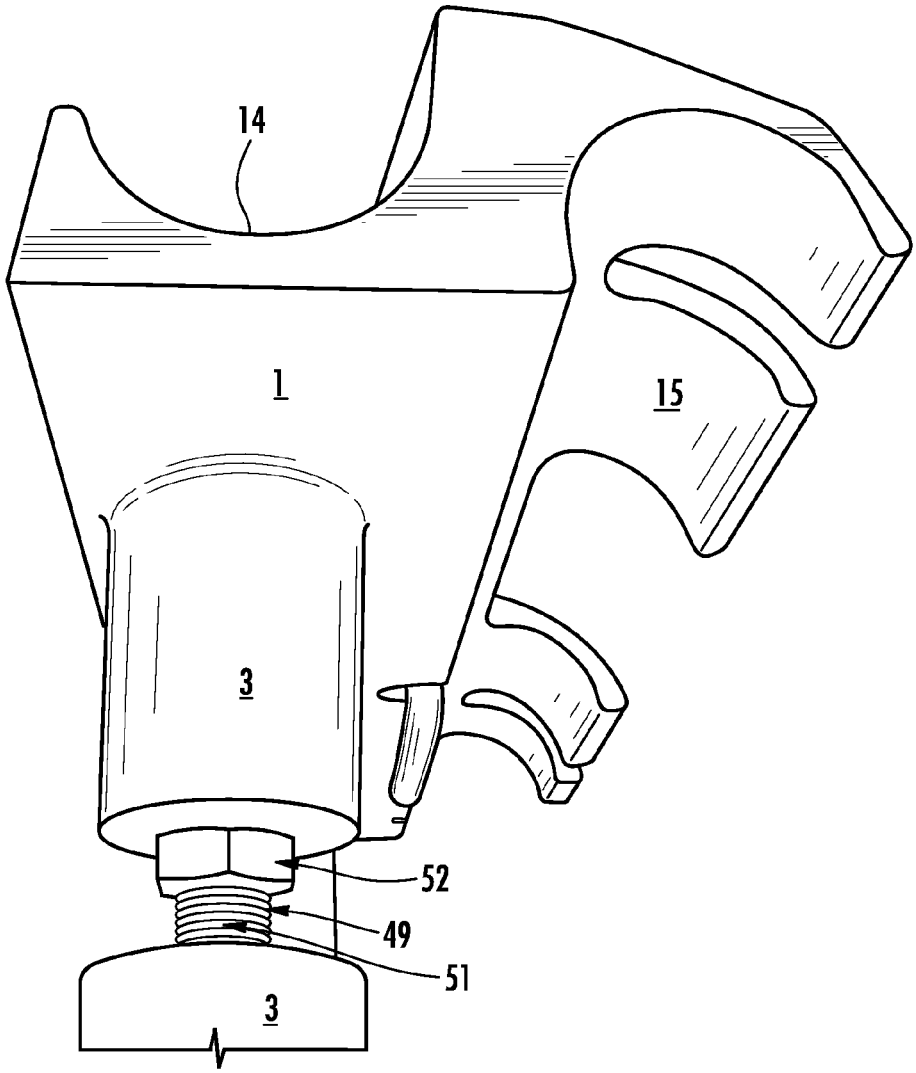
FIG. 12 is a perspective view of the upper assembly of the ladder caddy showing the adjustment means for adapting the ladder caddy to differences in distances between ladder rungs or steps.
Figure 13:
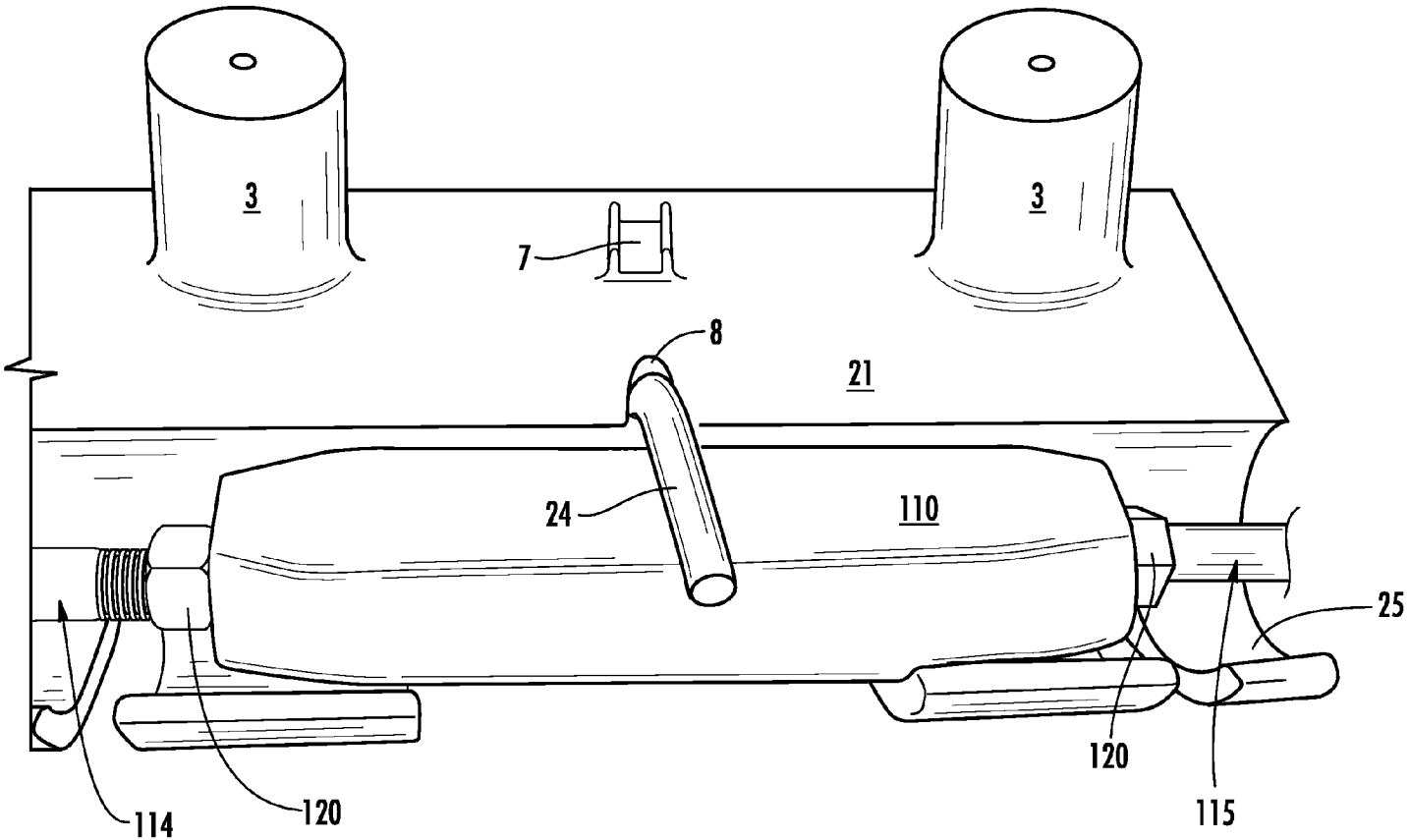
FIG. 13 is a perspective view of the lower assembly of the ladder caddy viewed from above and from the front to show the tool bar assembly mounted in the lower mounting cradle.
Figure 14:
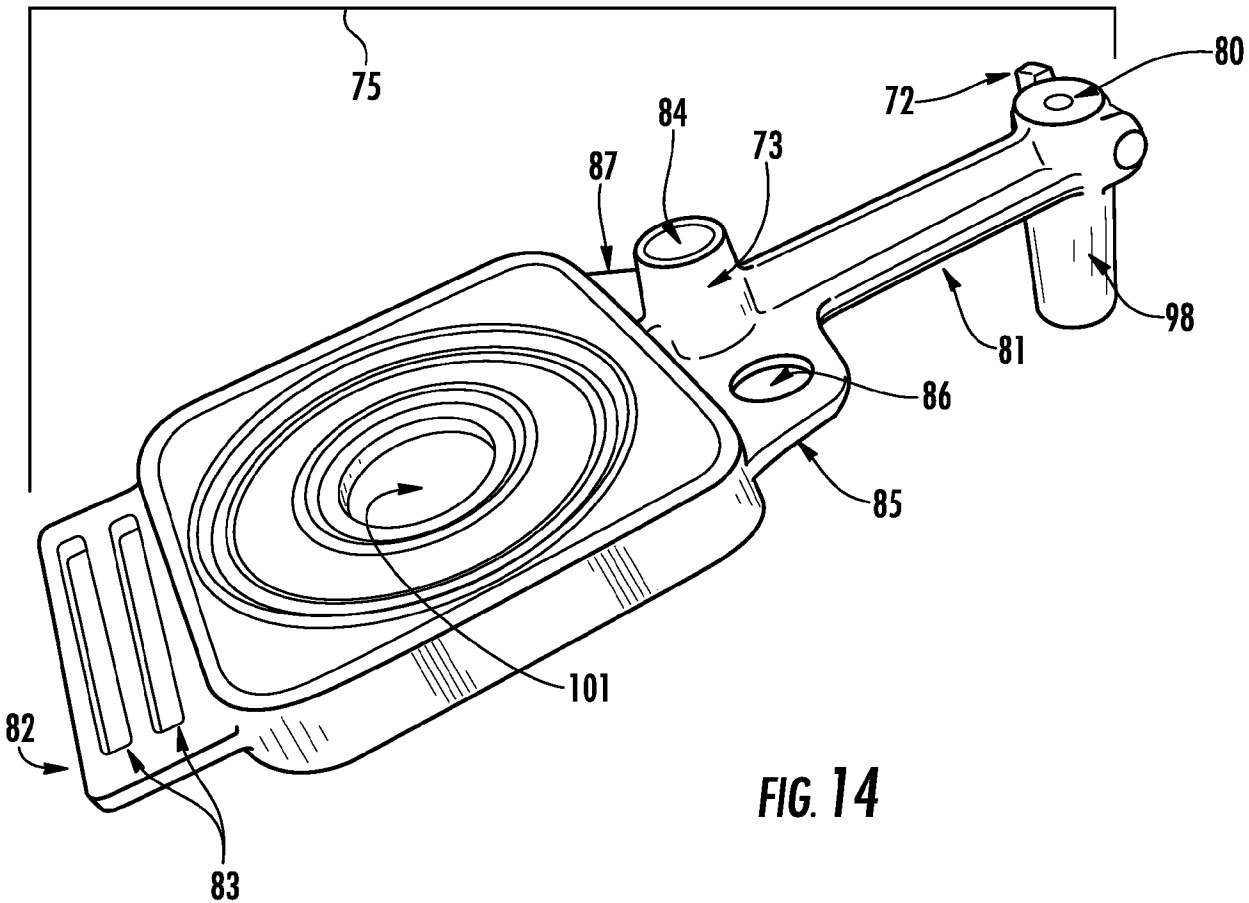
FIG. 14 is a perspective view of one of the swingable paddle shaped tool trays showing the tray from above.
Figure 15:
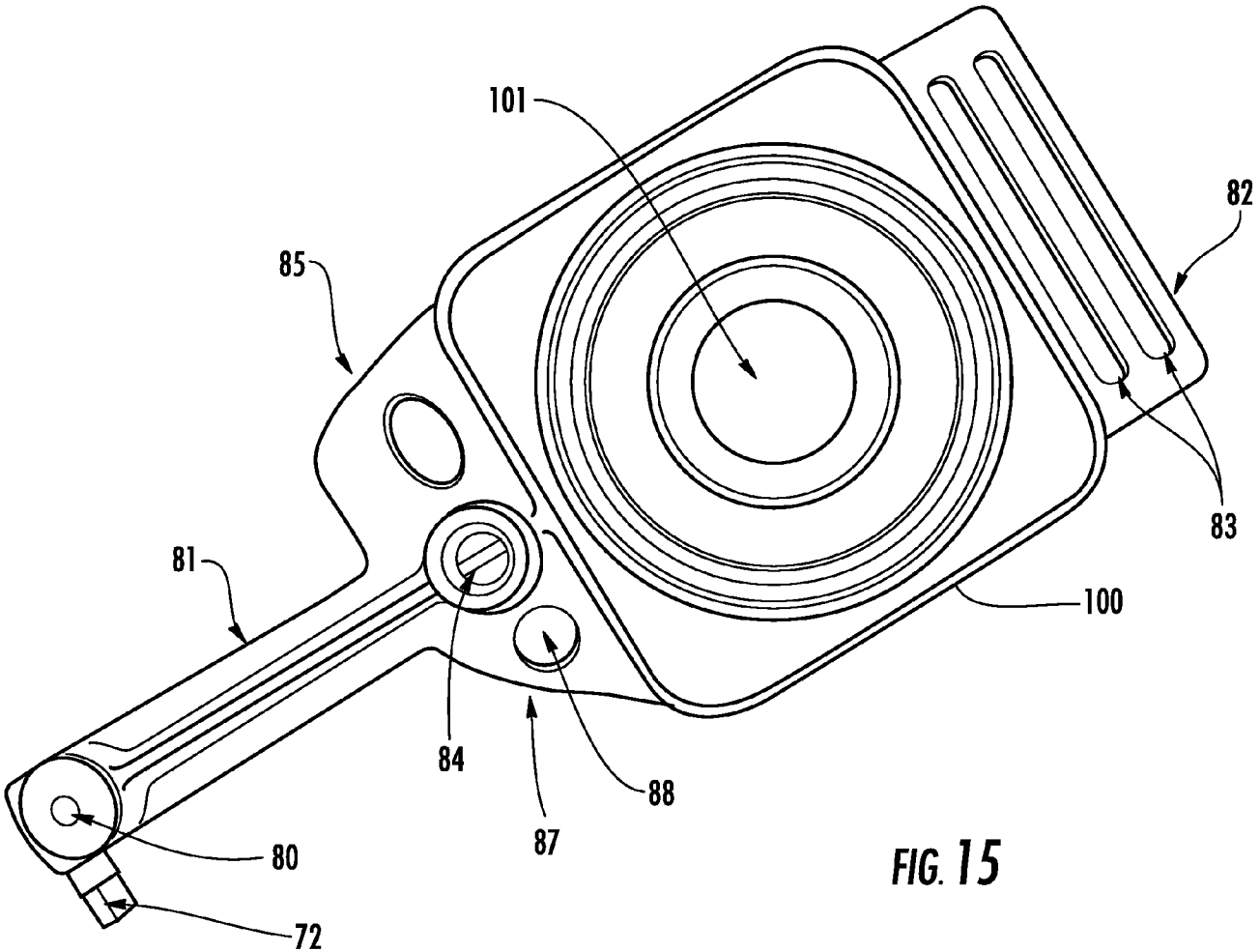
FIG. 15 is a perspective view of the tool tray of FIG. 14 when viewed from below.
Figure 16:
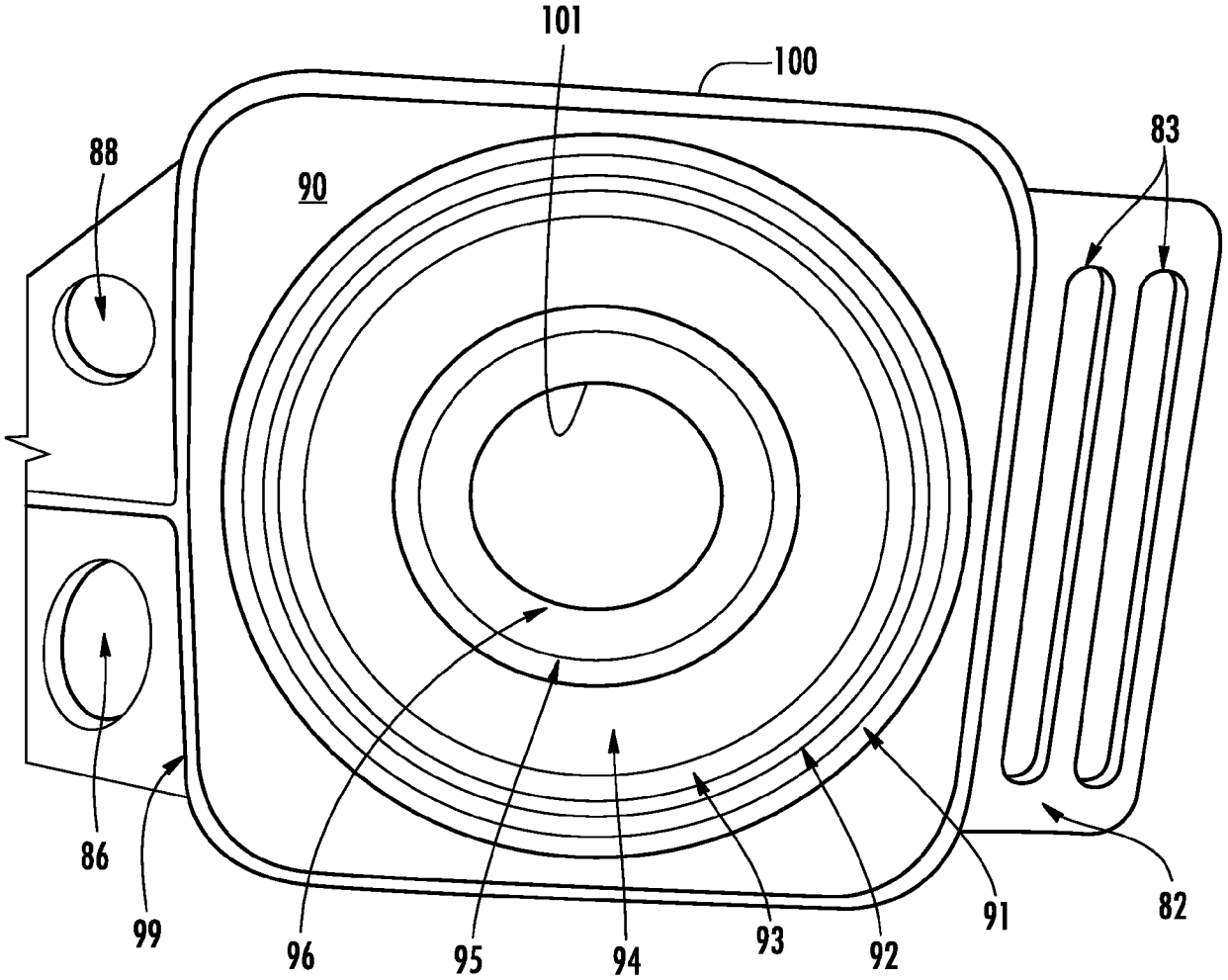
FIG. 16 is an enlarged view of the tool tray of FIG. 15.

Raised bosses 3 (FIGS. 6, 8, 10) are preferably formed as an integral part of upper mounting cradle 1 and lower mounting cradle 21 and are center drilled with holes 17 to provide through access for bolts 49 (FIGS. 10*a*, 12). The bosses 3 and bolts 49 provide adjustable connectors which attach the upper mounting cradle 1 to the lower mounting cradle 21 at spaced-apart positions. Bolts 49 each have at one end a bolt head 50 while at the other end there is a male threaded surface 51. Bolt head recesses 4 in the upper mounting cradle 1 (FIG. 5) allow for the heads 50 (FIG. 4) of bolts 49 to remain below the surface of concave mounting surface 14, and recesses 4 are of a large enough diameter to accept a suitable bolt wrench 20 (FIG. 10*a*). Male threaded surface 51 threads into female threaded holes 23 located on bosses 3 of lower mounting cradle 21 (See FIGS. 9 and 10). Wrench 20 provides a convenient way to adjust the bolts 49 to different makes, models and rung dimensions of most industry standard aluminum and fiberglass extension ladders. Wrench 20 is tubular in construction with stamped bolt end recess 53 located on one end and fits over bolt head 50 within bolt head recess 4. Wrench handle hole 54 provides a hole for extra means of leverage for tightening, loosening or adjusting vertical parallel pivoting bolts 49. By simply pushing the shaft of a common screw driver through wrench handle hole 54, the screwdriver becomes an added means for adjusting the bolts. When bolts 49 are in the correct adjusted position, lower concave surfaces 15 of upper mounting cradle 1 and lower concave mounting surface 26 of lower mounting cradle 21 engage consecutive ladder rungs simultaneously. Once the bolts 49 are adjusted properly, jamb nuts 52 lock the bolts 49 into place by tightening them against the bosses 3 and thereby prevent the bolts 49 from turning when paddle shaped trays 75 (FIGS. 14-17 and described hereinafter) are in place and in their locked positions.

As best seen in FIG. 5, a carrying handle 2 is attached to the uppermost surface of upper mounting cradle 1. Handle 2 can be made of different materials and be attached in a variety of ways, including a horizontal position which position allows the user to move the ladder caddy assembly up and down the ladder and into attaching position on consecutive ladder rungs. Carrying handle 2 can be collapsible, foldable or be constructed of a flexible rubber or rope with attached grip 18. Carrying handle grip 2 may also be constructed so as to be extendable by pulling out the handle either horizontally or vertically. The height and width of handle 2 allow for easy access to the spring loaded clamping mechanism 16 should handle 2 be mounted directly above spring loaded clamping mechanism 16. Rubber handle grip 18 provides a secure hand grip for carrying the ladder caddy assembly.

Figure 19:
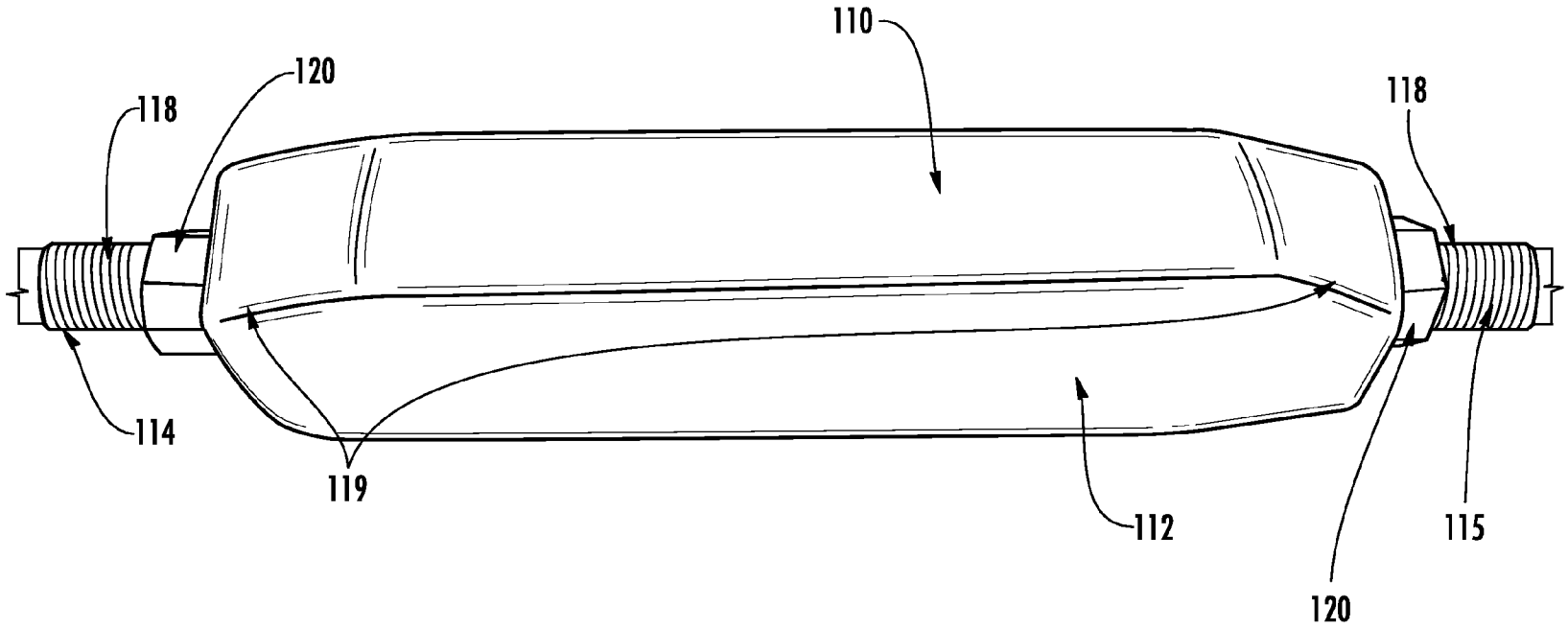
FIG. 19 is a perspective view of the winged tool bar assembly that can be mounted in one of the mounting cradles of the ladder caddy.

A concave mounting surface 14 (FIG. 5) formed on the upper side of upper mounting cradle 1 and a concave mounting surface 25 (FIG. 10) in the upper side of lower mounting surface 21 provide a resting area for elongated tools, such as levels, framing squares and/or piping, molding, trim and conduit. Concave mounting surfaces 14 and 25 can also provide a resting area for winged bar assembly 110 (see FIGS. 19, 20). In the event the concave mounting surface 14 is used to attach winged bar assembly 110, then spring loaded clamping mechanism 16 must be inverted and reinstalled on lower mounting cradle 21. This is accomplished by reversing the mounting positions of the spring loaded clamping mechanism 16 and the secure clamping mechanism 22 of the lower mounting cradle 21. In this reversed position, the secure clamping mechanism 22 then holds the winged tool bar 109 which rests in concave mounting surface 14 of the upper mounting cradle 1, while the spring loaded clamping mechanism 16 is then reinstalled on lower mounting cradle 21 and then clamps cradle 21 onto the ladder rung.

When the winged tool bar assembly 109 is mounted in the concave surface 25 of the lower mounting cradle 21, handle 9 of the secure clamping mechanism assembly 22 locks the winged tool bar assembly 109 in place in concave mounting surface 25. Acorn nut 10 keeps the handle 9 from detaching itself from clamp bar 24. The secure clamping mechanism assembly 22 is attached to the lower mounting cradle 21 through means of a slotted hole 8 which allows the clamp bar 24 to rest in place in the unlocked position of the docking slot 7 (FIG. 8) or in the 180 degree reversed position where it securely holds the winged tool bar assembly 109 in concave mounting surface 25. If the winged tool bar assembly 109 is not in use, concave mounting surface 25 can be used to provide a resting area for other elongated tools, such as levels and framing squares and/or piping, molding, trim and conduit.

Winged tool bar assembly 109 (FIGS. 13, 19-21) includes a cylindrical central section 110 for fitting within concave mounting surface 14 of upper mounting cradle 1 or concave mounting surface 25 of lower mounting cradle 21. It includes a flat section 112 for being clamped to either concave mounting surface 14 or 25 of either cradle 1 or 21 by means of a secure clamping mechanism 22. Flat section 112 prevents cylindrical section 110 from rotating within the cradle 1 or cradle 21. The winged bar assembly 109 can be easily removed from either cradle 1 or 21 when not in use simply by loosening handle 9 from clamp bar 24. Winged tool bar assembly 109 further includes removable elongated sections 114 and 115 which may have rounded, bent tips 117 (FIG.

Figure 8:
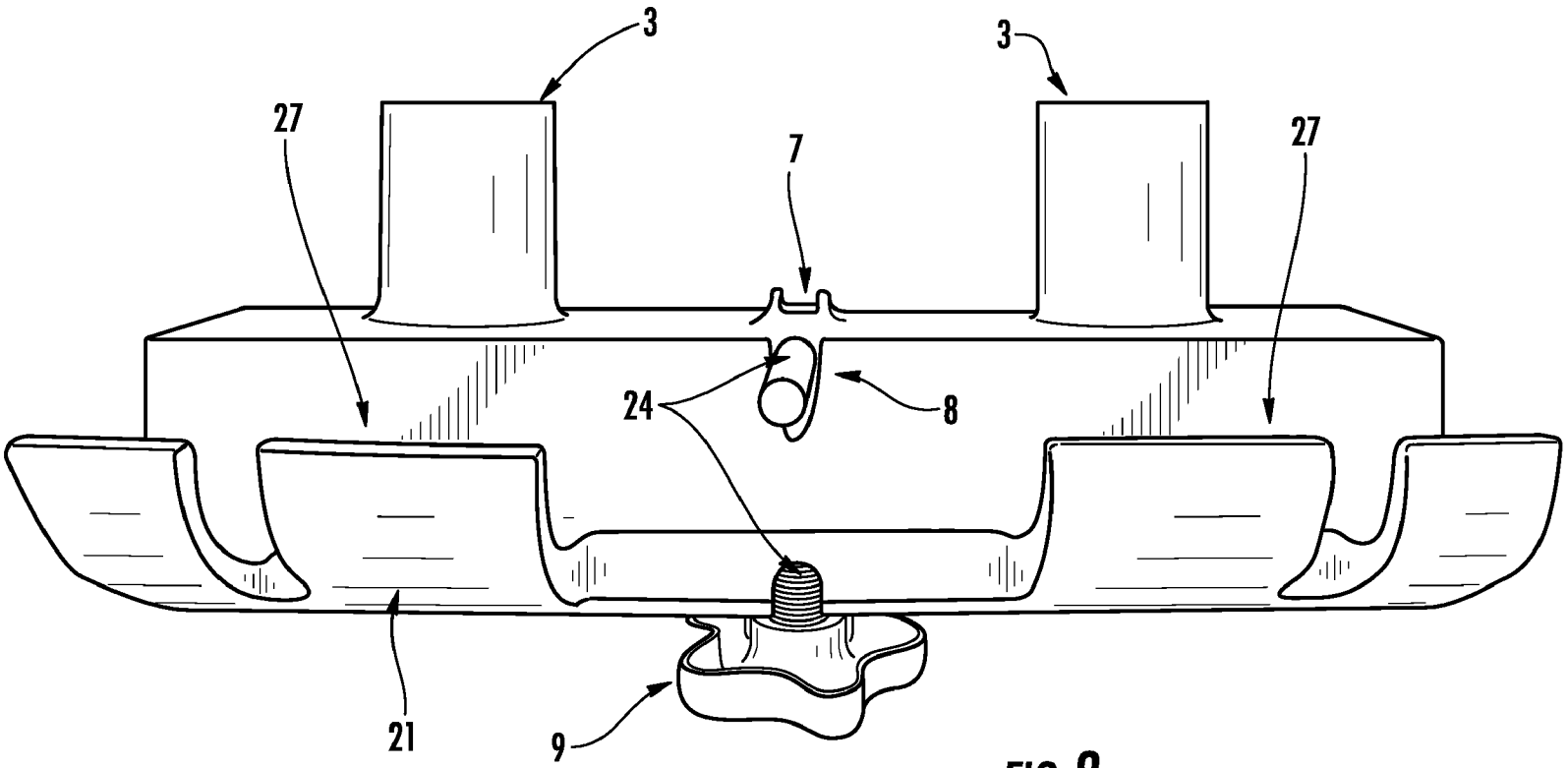
FIG. 8 shows a perspective view of the lower assembly of the ladder caddy of FIG. 1 when viewed from the front.
Figure 20:
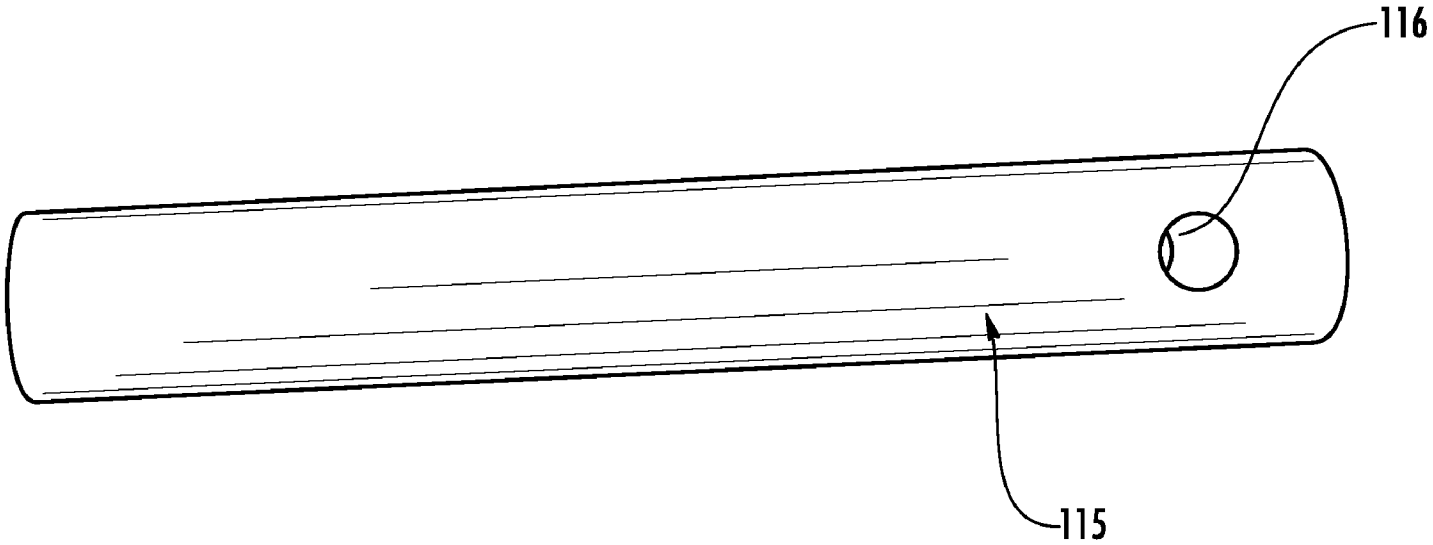
FIG. 20 is a view of one of the components of the winged tool bar assembly of FIG. 19.
Figure 21:
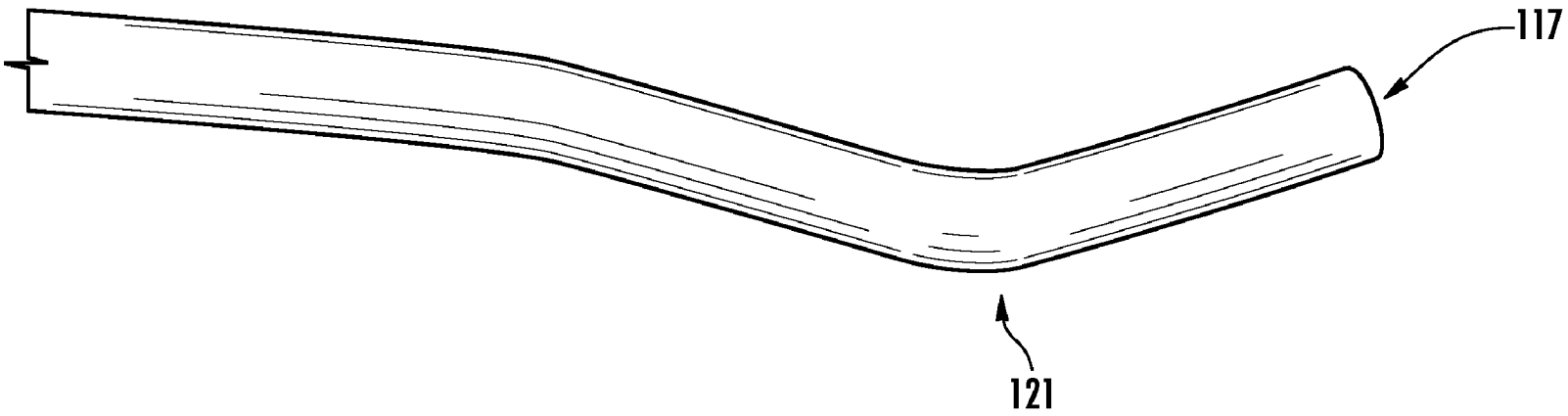
FIG. 21 is a view of additional components of the winged tool bar assembly of FIG. 19.

21). Also, sections 114 and 115 may have an opening 116 near the outer end as illustrated in FIG. 20 for section 115, which opening 116 is useful for holding a variety of objects. Elongated sections 114 and 115 are attached to cylindrical section 110 by means of male threaded ends 118 on elongated sections 114 and 115 and female threads at ends 119 of cylindrical central section 110. Sections 114 and 115 can be removed when not in use and when used are locked onto center section 110 by means of jamb nuts 120. These sections are suitable for holding coils of rope, hose, electrical cord, and the like. A formed section 121 at the bent tip 117 (FIG. 21) helps to retain a coil of cord hung on winged tool bar assembly 109. These upturned tips formed sections 121 can also hold power tools having handles with an enclosed D shape such as heavy duty power drills, reciprocating/circular saws, air nailers, and small chain saws. Sections 114 and 115 are set apart at a distance greater than the width of a ladder. Because of this, winged tool bar assembly 109 can hold long lightweight tools and building materials such as dimensional lumber, conduit, tubing, piping, trim, and molding. Winged bar cylindrical center section 110 can be positioned within upper concave mounting surfaces 14 or 25 of either cradle 1 or 21 with sections 114 and 115 and the upturned tips 116 and 117 spaced equal distances from the ladder, or can be adjusted side to side within the concave mounting surfaces of either cradle so that one end can be closer to or farther from the ladder as needed for holding lighter weight bulky items away from the ladder or heavier items closer to the ladder. Winged tool bar assembly 109 can also be moved side to side to accommodate inside structural corners of buildings where a ladder may be placed next to a perpendicular wall. The fast tightening knob 9 and clamp bar 24, which thread together, cooperate to form a secure clamping assembly 22 for holding cylindrical center section 110 securely to concave mounting surfaces 14 and 25 of either the upper or lower cradles 1 and 21. The handle 9 and clamp bar 24 may be formed with the male thread on clamp bar 24 and the female thread within knob 9, as shown in FIG. 8, or vice versa. Acorn nut 10 secures knob 9 onto clamp bar 24 and prevents know 9 from becoming detached from the clamp bar 24. Alternatively, other types of clamping mechanisms may be used. Winged tool bar assembly 109 is preferably constructed of a high strength material such as plastic, fiberglass, or a metal alloy.

Power cord slots 5 and carpenters level opening 19 are formed in the both the upper mounting cradle 1 and lower mounting cradle 21 for structural molding purposes, but slots 5 and opening 19 on the lower mounting cradle 21 (FIGS. 8, 9) are useful for holding and guiding power cords and other tools such as a carpenter's level. Power cord slots 5 allow electrical power cords to be held in place by bringing electrical power cord up through one slot 5, horizontally across upper concave mounting surface 25, then down thru the opposite slot 5, thereby holding the power cord in place. By placing the power cord in this position, the power cord is relieved of any undo pulling action on the power cord end which can be created by the weight of the power cord. Carpenters level opening 19 provides an opening for the center horizontal bubble area of some leveling devices. Flanges 27 (FIG. 8) also provide a hanging area for various tools or straps.

Figure 17:
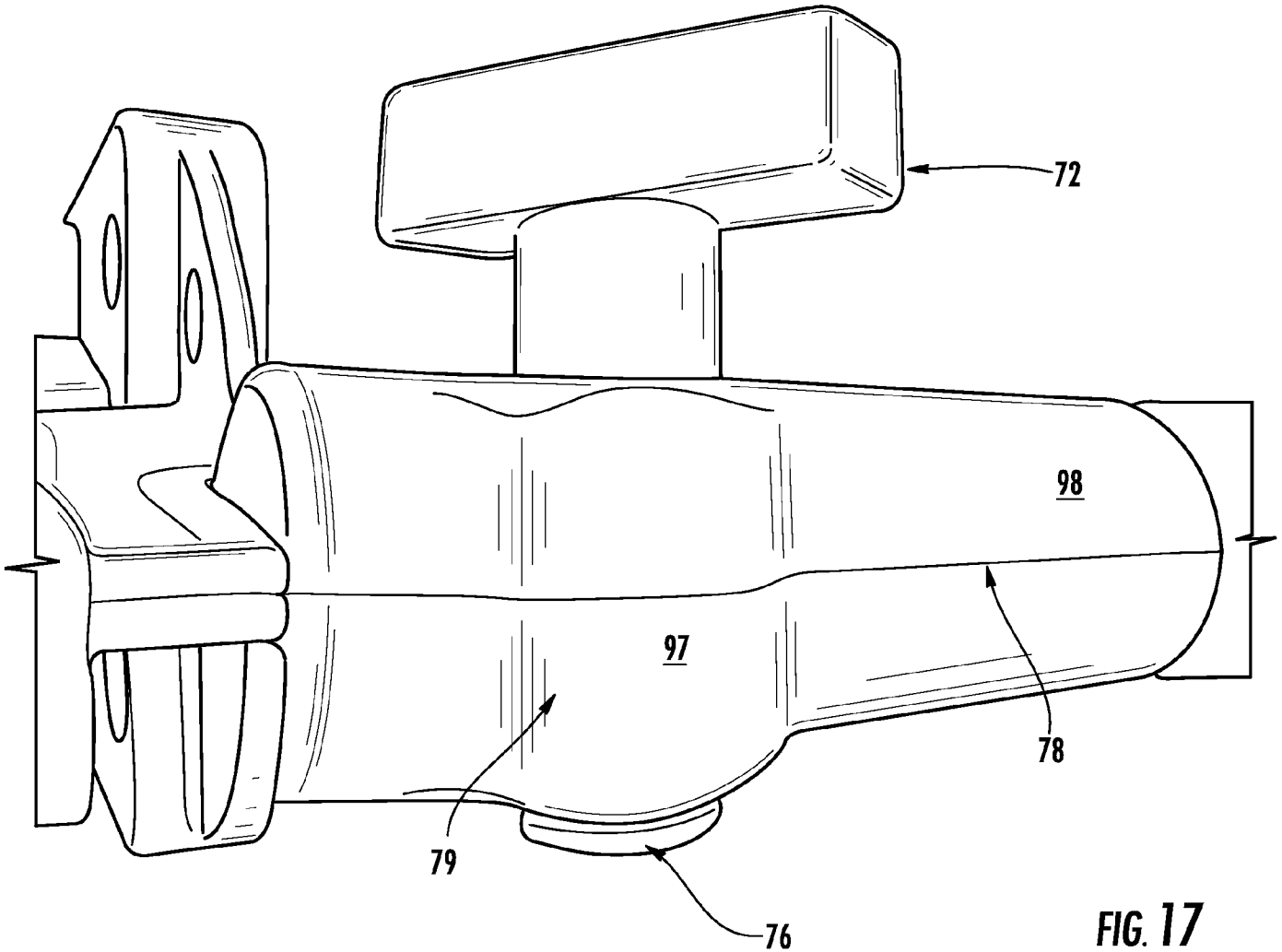
FIG. 17 is an enlarged view of the clamping mechanism for locking the tool tray into a selected position.

Paddle shaped trays 75 (FIGS. 14-17) have a number of features which enable the user to position different sizes of paint containers as well as hold various tools safely. The paddle shaped trays 75 are preferably constructed of a strong material such as plastic, fiberglass, or a metal alloy and are identical to each other and can be used singly or simultaneously. The tops of each paddle shaped tray 75 are mirror images of the bottom, allowing the tray to be positioned in either position. A center hole 80 acts as center hub pivot for each tray 75 to pivot on either vertical parallel pivoting bolt 49, allowing each tray 75 to swing side to side against the upright rails of the ladder or away from the user. By extending either tray 75 between the rungs of the ladder, the tray 75 can act as a storage area located on the opposite side of the ladder from the user. The paddle trays 75 are designed to be offset so they can swing under or over each other in nearly any position away or toward the user or be stacked one above the other. Each tray 75 can be locked into place on vertical parallel pivoting bolts 49 by tightening clamping knob 72, which prevents the tray 75 from moving. Clamping knob 72 is attached to clamping bolt 76 through clamping bolt hole 97 located on boss 79 on the vertical mounting area 98 of tray 75 (FIG. 17). Slot 78 allows vertical mounting 98 area some inward movement around clamping bolt hole 97, allowing clamping knob 72 to clamp the entire tray 75 to the vertical parallel pivoting bolts 49. Horizontal extension 81 provides horizontal strength for the tray area 100. Webbed flange 85 provides further strength for the tray area. Webbed flange 85 has tool holes 88, an adequate sized hole, allowing appropriate size tools such as crowbars, pry bars, chisels or screw drivers to be positioned downward into the hole 88. Webbed flange 85 also provides further strength for the tray area 100, but is slightly larger and has an oval shaped hammer handle hole 86 formed within the flange 85 allowing the flange 85 to act as a holder for most industry standard hammers by positioning the hammer handle downward into the hole 86. Tray area 100 consists of center drill hole 101, providing an appropriate sized hole for most power drill chucks including attached drill bits of any length. (See FIG. 1). Center drill hole 101 also has a ledge 96 formed around it which acts as a receiver for a separate ridged lip storage cup (not shown), the ledge 96 preventing the cup from pushing downward thru the hole 101. The ridged lip storage cup is designed to hold small hardware items and can be easily removed. Quart can ridge 95 provides an inner locating ridge underneath the bottom rim of a standard quart can (see FIGS. 2-4), keeping the can in position and preventing excess paint from dripping out of drill hole 101. Flat circular area 94 provides an area for excess paint can drips when using a one quart can. Gallon can inner ridge 93 also provides an inner locating ridge underneath the bottom rim of a standard one gallon paint can, keeping the can in position and preventing excess paint, from traveling under the can. Gallon can outer ridge 91, prevents excess paint from traveling away from the can. Paint can groove 92 lies between outer ridge 93 and inner ridge 91, providing a resting groove for the bottom edge of an industry standard one gallon paint can. Retaining ridge 99 holds a industry standard one gallon square plastic paint container in place and also provides a retaining ridge for 4 small corner hardware holding areas 90 located in the corners of the tray area inside of ridge 99. Tool flange 82 located at the end of the tray area 100 is equipped with two tool slots 83, providing a retaining area for flat tools such as tri-squares, speed squares, framing squares, flat bars, chisels and screwdrivers. Tool slots 83 can also be used for attaching hanging "S" hooks for holding a number of other items.

Bosses 73 are located on both sides of the tray 75 on the outward ends of the horizontal extension 81. Each boss 73 serves two purposes, the first providing a receptacle for wrench 20. When wrench 20 is pushed into female threaded pipe hole 84, the wrench 20 becomes a roll holder for paper towels, masking paper/tape or the like.

Figure 2:
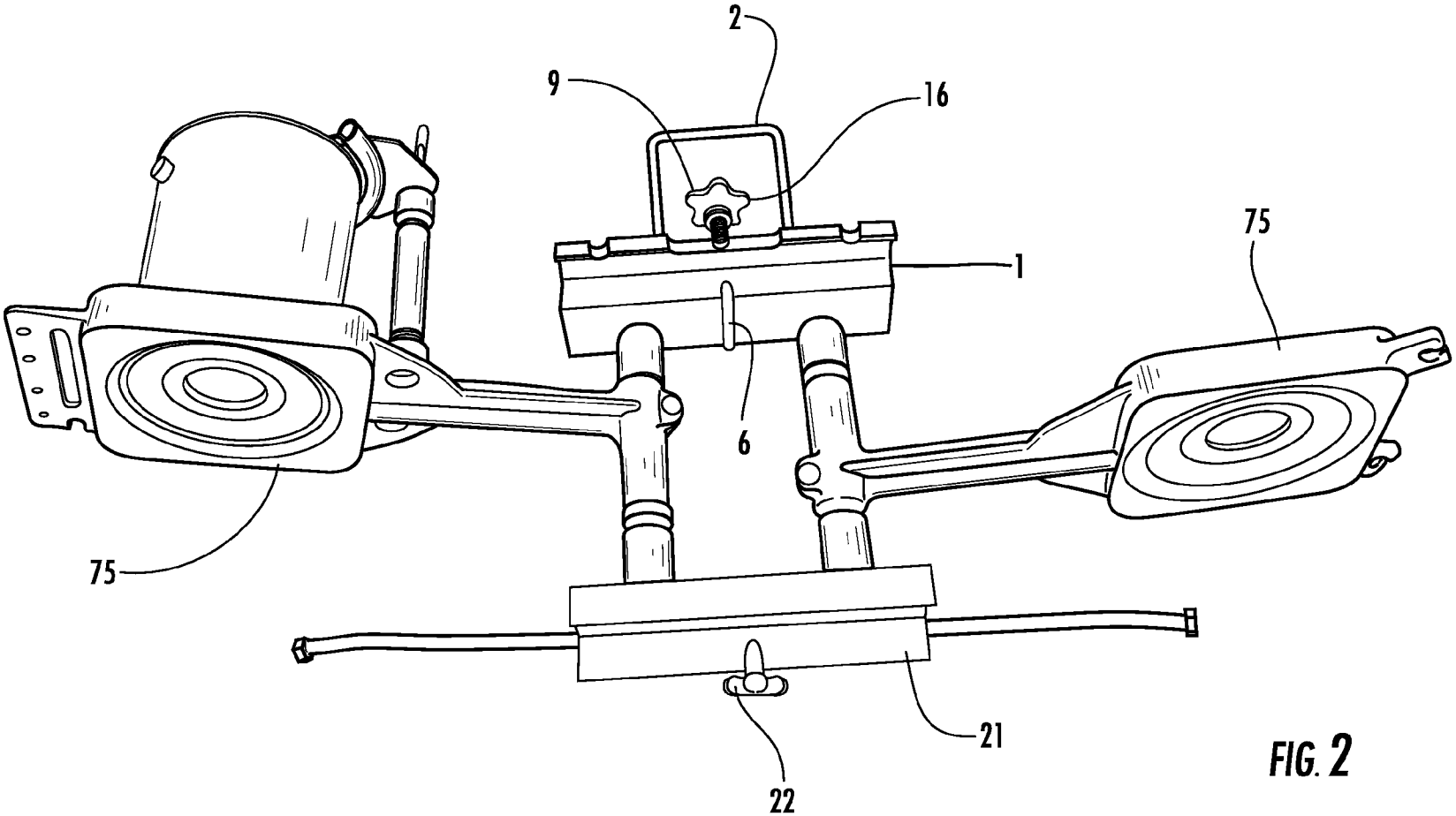
FIG. 2 is a perspective view showing the ladder caddy viewed from the rear and from below.
Figure 3:
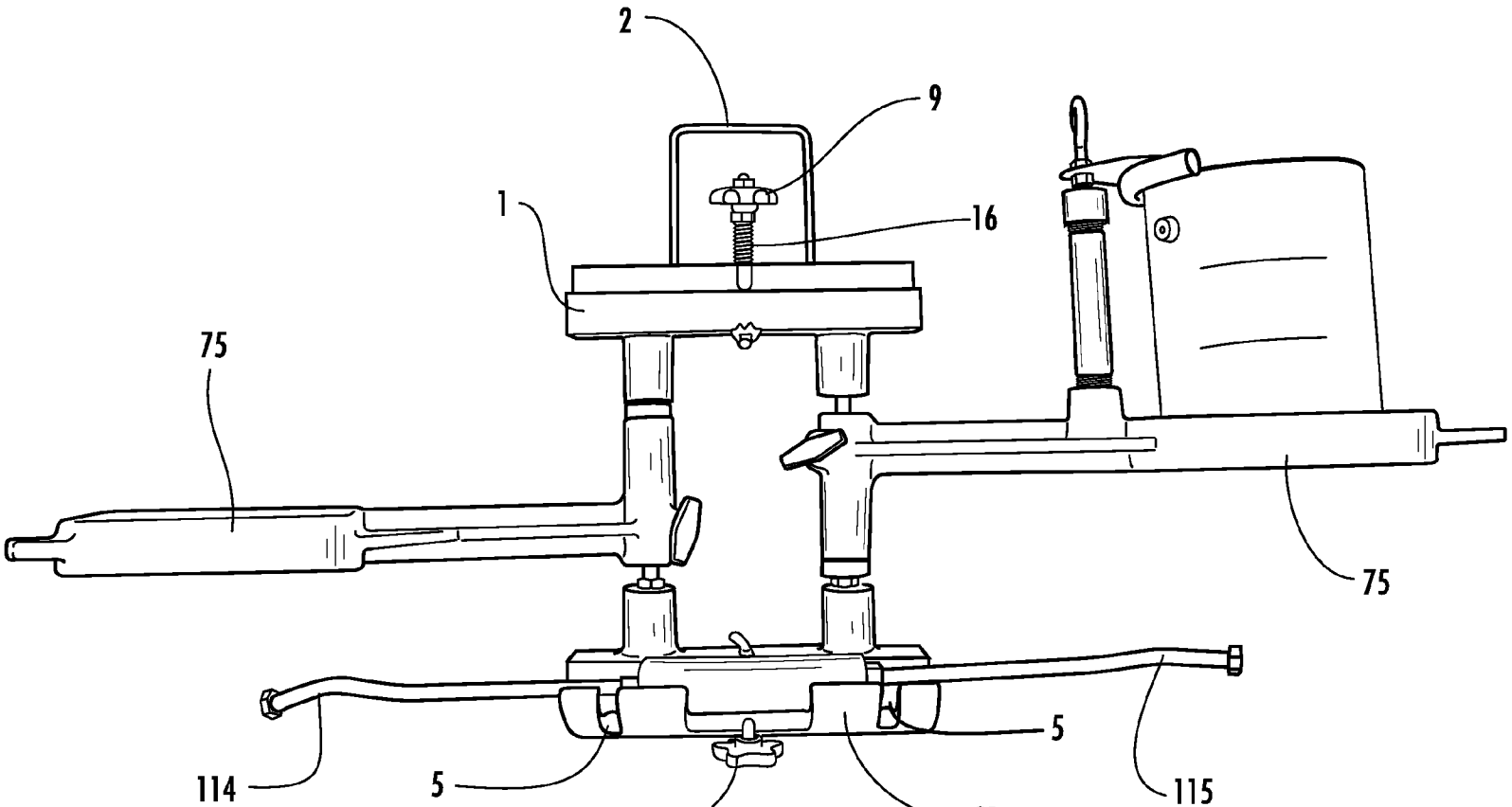
FIG. 3 is a perspective view showing the ladder caddy of FIG. 2 viewed from the front and from slightly above.
Figure 4:
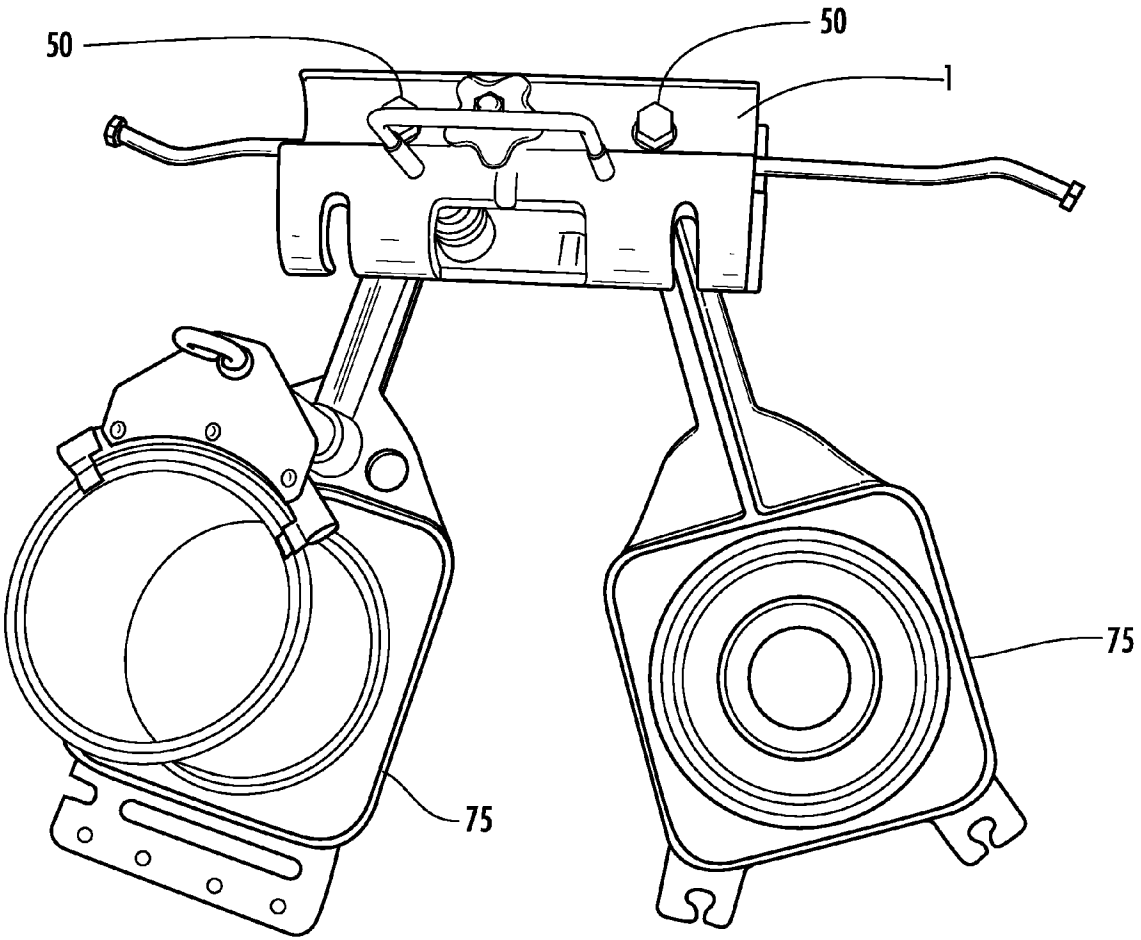
FIG. 4 shows a top or plan view of the ladder caddy of FIGS. 2 and 3.
Figure 18:
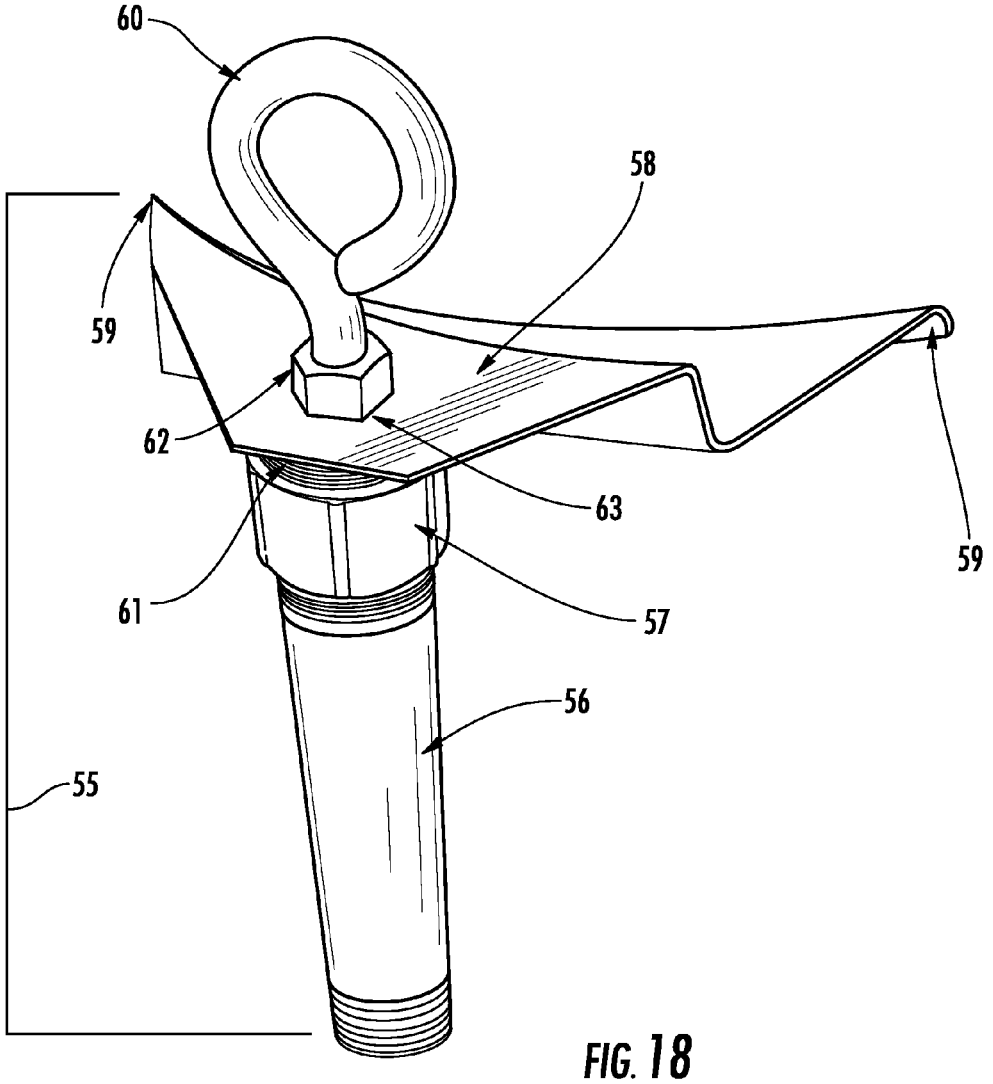
FIG. 18 is a perspective view of the spring loaded locking mechanism for holding a paint can, for example, in place on a tool tray.

FIG. 18 shows a paint can holding assembly. The female threaded holes 84 located on opposite sides of the tray 75 also provide a mated surface for a 6" long male threaded pipe nipple 56. Pipe cap 57 threads on to the opposite end of male threaded pipe nipple 56 and is center drilled to accept finger-bolt 60 which is then attached by means of upper nut 62, lower nut 61, spring 64 and spring retaining nut 65. Locking nuts 61 and 62 sandwich paint can retaining plate 58 and are locked in place by locked tooth washer 63. The downward extending longer threaded shank of finger-bolt 60 extends through the pipe cap 57 and down into the pipe nipple 56 and is attached to the pipe cap and nipple with the use of spring 64 and spring retaining nut 65 located underneath the pipe cap 57 in the cavity of pipe nipple 56. Paint can retaining tabs 59 are formed onto the lower inner curved edge of paint can retaining plate 58. The lower curved inner edge of the paint can retaining plate is shaped to fit a standard one gallon paint can. In the locked position, these retaining tabs 59 are positioned so that each tab extends outwardly and downwardly into the paint can lid groove. The tabs 59 thereby hold a standard one gallon paint can securely to the tray 75. The entire pain can retainer assembly 55 can easily be removed in one piece by unthreading the pipe nipple 56 from the female threaded pipe hole 84. When in use, the paint can be locked in place using the quick release mechanism provided by pulling upward on finger-bolt 60, then quickly moving the paint can into position on the tray 75 and turning the eye bolt 60 so as to position the paint can retaining tabs 59 into the paint can lid groove. To remove the can quickly, simply pull up on the finger bolt 60 and twist the paint can retaining 180 degrees towards the ladder and then lift paint can off tray 75. This paint can retaining assembly is shown in FIGS. 2, 3 and 4 with a paint can being held in place.

As is evident from the above description and the drawings, bosses 3 for the upper mounting cradle 1 extend downwardly from the portion of the cradle 1 that forms the mounting surface 14 (FIG. 5) that is on the upper side of upper cradle 1 (FIG. 6), while bosses 3 for the lower mounting cradle 21 extend upwardly from the portion of the cradle 21 that form the concave mounting surface 25 (FIG. 10) in the upper side of lower cradle 21. Therefore, the upper mounting surface 15 of upper cradle 1 and the upper mounting surface 26 of the lower cradle 21 are offset horizontally so that when the cradles 1 and 21 are secured to the rungs of a ladder, leaning at the standard, recommended lean of 15 degrees, the paddle shaped trays 75 will be substantially level.

Upper mounting cradle 1 and lower mounting cradle 21 are preferably formed of a strong yet lightweight material such as plastic, fiberglass, or lightweight metal alloy. If the cradles 1 and 21 are formed of metal, they may be coated with a non-conductive coating such as rubber for safety. As will be evident from the drawings and the foregoing description, the lower mounting cradle 21 is substantially similar to upper mounting cradle 1, except that it is positioned in an inverted position opposite and below upper mounting cradle 1 when the two cradles 1 and 21 are joined to form the ladder caddy assembly. This allows the two cradles to be formed from the same mold. In addition, this also provides a means for inverting the entire ladder caddy assembly and mounting it upside down from its normal position on a ladder but on the opposite side of the ladder. There are situations where this may be an advantage.

It will be appreciated that the term "present invention" as used herein should not be construed to mean that only a single invention having a single essential element or group of elements is presented. Similarly, it will also be appreciated that the term "present invention" encompasses a number of separate innovations which can each be considered separate inventions. Although the present invention has thus been described in detail with regard to the preferred embodiments and drawings thereof, it should be apparent to those skilled in the art that various adaptations and modifications of the present invention may be accomplished without departing from the spirit and the scope of the invention. For example, the paddle shaped trays or lower/upper mounting cradles can be made from a single molded piece, or they can be made of two or more constituent parts affixed together. Various clamping mechanisms could be used. A great variety is possible regarding the number, sizes, shapes, and placement of holes, slots, ridges, cups, and holders. The surfaces which form the ladder rung cradles need not be smoothly rounded in the D-shapes shown, but could be angled to form rectangular recesses, and could be of varying depths, and could be specifically adapted and made adjustable for placement upon round rungs, D-rungs, flat rungs, or other shaped rungs. The structural features can also take a wide variety of shapes, and could include various supports or webs added for additional strength in supporting the horizontal extended paddle shaped tray area. Accordingly, it is to be understood that the detailed description and the accompanying drawings as set forth hereinabove are for purposes of showing the preferred and best embodiments of the invention and are not intended to limit the breadth of the present invention, but rather all modifications as would be obvious to one skilled in the art are intended to be included within the scope of the following claims.

What is claimed is:

1. An apparatus for holding tools and accessories within reach of a workman on a ladder having spaced apart rungs, said apparatus comprising:

an upper mounting cradle and a lower mounting cradle spaced apart and combined together and adapted to engage rungs on a ladder;

an adjustable connector lockable in a selected position to provide for variations in the distance between the cradles so that the apparatus can be mounted on ladders with different rung spacing;

the adjustable connector comprising a pair of spaced apart bosses extending from the upper mounting cradle towards the lower mounting cradle, a corresponding pair of spaced apart bosses extending from the lower cradle towards the upper cradle and threaded members connecting the bosses to provide for varying the distance between the cradles;

an accessory tray having an arm and a mounting boss combined with the arm with the mounting boss positioned between one of the bosses extending from the upper mounting cradle and the corresponding boss extending from the lower mounting cradle, the threaded member extending through the mounting boss to provide for swingable movement of the tray around the threaded member;

the upper mounting cradle and the lower mounting cradle each having first and second concave surfaces, the first concave surfaces facing in a generally upward direction, and the second concave surfaces facing in a generally downward direction;

the second concave surfaces of the upper and lower mounting cradles being selectively engagable with two different rungs on one side of a ladder, with the adjustable connector lockable to thereby provide support for mounting the apparatus to the rungs of the ladder; and the first concave surfaces of the upper and lower mounting cradles providing a place for holding objects to be used by a workman on the ladder.

2. The apparatus of claim 1 in which the width of the second concave surfaces are adjustable to accommodate rungs of different widths.

3. The apparatus of claim 1 in which the upper mounting cradle is combined with a quick release clamping assembly to positively lock the apparatus onto a ladder rung.

4. The apparatus of claim 1 in which said apparatus can be mounted in a first position in which said second concave surfaces engage the rungs of the ladder so as to mount the apparatus on the ladder and in a second position inverted and generally upside down from the first position so that the first concave surfaces engage the rungs of the ladder to mount the apparatus on the ladder and the second concave surfaces provide a place for holding objects to be used by a workman on the ladder; the accessory tray being swingable in a generally horizontal plane about the connector when the apparatus is mounted on the ladder in either the first position or the second position.

5. The apparatus of claim 4 in which the width of the first concave surfaces are adjustable to accommodate rungs of different widths.

6. The apparatus of claim 4 in which the accessory tray is combined with a paint can retaining assembly that holds a can resting on the trap firmly on the tray.

7. The apparatus of claim 6 in which the paint can retaining assembly includes a quick release mechanism.

8. The apparatus of claim 1 in which the mounting boss of each accessory tray is combined with a locking member to lock the tray in a selected position.

9. The apparatus of claim 4 in which the accessory tray has an upper surface and a lower surface, the surfaces being substantially identical whereby the tray is useful for holding accessories when the apparatus is in its first position, and also useful for holding accessories when the apparatus is in its second position inverted and upside down from its first position.

10. The apparatus of claim 9 in which there are two accessory trays combined with the adjustable connector, the two trays being offset vertically so that the trays can be swung without interfering with each other.

11. The apparatus of claim 9 in which the accessory trays are substantially identical and each accessory tray is useable to hold accessories when the trays are in an inverted position whereby the trays are useful for holding accessories when the apparatus is in its first position, and also useful for holding accessories when the apparatus is in its second position inverted and upside down from its first position.

* * * * *